US006976365B2

(12) United States Patent
Forkosh et al.

(10) Patent No.: US 6,976,365 B2
(45) **Date of Patent: *Dec. 20, 2005**

(54) DEHUMIDIFIER/AIR-CONDITIONING SYSTEM

(75) Inventors: Mordechai Forkosh, Haifa (IL); Dan Forkosh, Atlit (IL); Tomy Forkosh, Haifa (IL)

(73) Assignee: Drykor Ltd., Atlit (IL)

( * ) Notice: Subject to any disclaimer, the term of this patent is extended or adjusted under 35 U.S.C. 154(b) by 0 days.

This patent is subject to a terminal disclaimer.

(21) Appl. No.: 10/468,658

(22) PCT Filed: Apr. 23, 2001

(86) PCT No.: PCT/IL01/00373

§ 371 (c)(1),
(2), (4) Date: Aug. 20, 2003

(87) PCT Pub. No.: WO02/066901

PCT Pub. Date: Aug. 29, 2002

(65) Prior Publication Data

US 2004/0112077 A1 Jun. 17, 2004

Related U.S. Application Data

(63) Continuation-in-part of application No. 09/554,397, filed as application No. PCT/IL98/00552 on Nov. 11, 1998, now Pat. No. 6,487,872, and a continuation-in-part of application No. 09/936,671, filed as application No. PCT/IL00/00105 on Feb. 20, 2000, now Pat. No. 6,494,053.

(30) Foreign Application Priority Data

Feb. 20, 2001 (IL) ..... 141579

(51) Int. Cl.[7] ..... F25D 23/00

(52) U.S. Cl. ..... 62/94; 62/173; 62/271

(58) Field of Search ..... 62/271, 264, 89, 62/90, 92, 93, 94, 173, 262, 176.5, 332, 238.6

(56) References Cited

U.S. PATENT DOCUMENTS

| | | | |
|---|---|---|---|
| 2,218,407 | A | 10/1940 | Meyerhoefer |
| 2,672,024 | A | 3/1954 | McGrath |
| 2,690,656 | A | 10/1954 | Cummings |
| 2,798,570 | A | 7/1957 | Kelley |
| 2,952,993 | A | 9/1960 | Bosworth |

(Continued)

FOREIGN PATENT DOCUMENTS

| | | |
|---|---|---|
| EP | 0 217 656 | 4/1987 |

(Continued)

OTHER PUBLICATIONS

Patent Abstracts of Japan, vol. 1999, No. 10, Aug. 31, 1999 & JP 11 137948, Daikin Ind Ltd, May 25, 1999.

*Primary Examiner*—Harry B. Tanner
(74) *Attorney, Agent, or Firm*—Fenster & Company

(57) ABSTRACT

Apparatus for conditioning air comprising: a quantity of liquid desiccant (28); a dehumidifier section (12) in which air to be conditioned is brought into contact with a first portion of the liquid desiccant; a regenerator section (32) in which outside air is brought into contact with a second portion of the liquid desiccant; and a refrigeration system (45) having a first heat exchanger (46) associated with the first portion of liquid desiccant and a second heat exchanger (36) associated with the second portion of liquid desiccant and a third heat exchanger (136) that does not contact the liquid desiccant.

28 Claims, 13 Drawing Sheets

U.S. PATENT DOCUMENTS

| | | | | | |
|---|---|---|---|---|---|
| 3,264,840 | A | * | 8/1966 | Harnish | 62/173 |
| 3,311,355 | A | | 3/1967 | Rait | |
| 4,180,985 | A | | 1/1980 | Northrup, Jr. | |
| 4,259,849 | A | | 4/1981 | Griffiths | |
| 4,270,362 | A | * | 6/1981 | Lancia et al. | 62/173 |
| 4,373,347 | A | | 2/1983 | Howell et al. | |
| 4,430,864 | A | | 2/1984 | Mathiprakasam | |
| 4,474,021 | A | | 10/1984 | Harband | |
| 4,635,446 | A | | 1/1987 | Meckler | |
| 4,685,617 | A | | 8/1987 | Assaf | |
| 4,691,530 | A | | 9/1987 | Meckler | |
| 4,700,550 | A | | 10/1987 | Rhodes | |
| 4,723,417 | A | | 2/1988 | Meckler | |
| 4,819,444 | A | | 4/1989 | Meckler | |
| 4,887,438 | A | | 12/1989 | Meckler | |
| 4,905,479 | A | | 3/1990 | Wilkinson | |
| 4,910,971 | A | | 3/1990 | McNab | |
| 4,939,906 | A | | 7/1990 | Spatz et al. | |
| 4,941,324 | A | | 7/1990 | Peterson et al. | |
| 4,955,205 | A | | 9/1990 | Wilkinson | |
| 4,984,434 | A | | 1/1991 | Peterson et al. | |
| 4,987,750 | A | | 1/1991 | Meckler | |
| 5,020,334 | A | | 6/1991 | Wilkinson | |
| 5,022,241 | A | | 6/1991 | Wilkinson | |
| 5,058,394 | A | | 10/1991 | Wilkinson | |
| 5,070,703 | A | | 12/1991 | Wilkinson | |
| 5,191,771 | A | | 3/1993 | Meckler | |
| 5,197,299 | A | | 3/1993 | Sohn et al. | |
| 5,213,154 | A | | 5/1993 | Marsala et al. | |
| 5,297,398 | A | | 3/1994 | Meckler | |
| 5,351,497 | A | | 10/1994 | Lowenstein | |
| 5,471,852 | A | | 12/1995 | Meckler | |
| 5,582,025 | A | | 12/1996 | Dubin et al. | |
| 5,661,983 | A | | 9/1997 | Groten et al. | |
| 5,791,153 | A | | 8/1998 | Belding et al. | |
| 5,816,065 | A | | 10/1998 | Maeda | |
| 5,826,641 | A | | 10/1998 | Bierwirth et al. | |
| 5,950,442 | A | | 9/1999 | Maeda et al. | |
| 6,000,684 | A | | 12/1999 | Pasch et al. | |
| 6,018,954 | A | | 2/2000 | Assaf | |
| 6,134,903 | A | | 10/2000 | Potnis et al. | |
| 6,138,470 | A | | 10/2000 | Potnis et al. | |
| 6,189,869 | B1 | | 2/2001 | Stanek et al. | |
| 6,216,483 | B1 | | 4/2001 | Potnis et al. | |
| 6,487,872 | B1 | * | 12/2002 | Forkosh et al. | 62/271 |
| 6,494,053 | B1 | * | 12/2002 | Forkosh et al. | 62/271 |
| 6,546,746 | B2 | * | 4/2003 | Forkosh et al. | 62/271 |

FOREIGN PATENT DOCUMENTS

| | | |
|---|---|---|
| EP | 0 397 458 | 11/1990 |
| GB | 2 252 738 | 9/1992 |
| JP | 11-137948 | 11/1997 |
| SU | 1 690 827 | 11/1991 |
| WO | WO 96/33378 | 10/1996 |
| WO | WO 98/29694 | 7/1998 |
| WO | WO 99/22180 | 5/1999 |
| WO | WO 99/26025 | 5/1999 |
| WO | WO 99/26026 | 5/1999 |
| WO | WO 00/55546 | 9/2000 |

* cited by examiner

DEHUMIDIFIER/AIR-CONDITIONING SYSTEM

RELATED APPLICATIONS

This application is a U.S. national filing of PCT Application No. PCT/IL01/00373, filed Apr. 23, 2001. This application is also a continuation in part of U.S. patent application Ser. No. 09/554,397 filed May 15, 2000, now U.S. Pat. No. 6,487,872 which is a US National Phase of PCT/IL98/00552 filed 11 Nov. 1998 and a continuation in part of U.S. application Ser. No. 09/936,671 filed Sep. 14, 2001, now U.S. Pat. No. 6,494,053 which is a 371 of PCT/IL00/00105, filed Feb. 20, 2000, the disclosures of all of which are incorporated herein by reference.

FIELD OF THE INVENTION

The present invention is related to the field of environmental control systems and more particularly, to the field of systems which combine dehumidification and air conditioning.

BACKGROUND OF THE INVENTION

In general, air conditioning systems not only reduce the temperature of the ambient air, but also remove substantial amounts of water from it. This is especially true when the air conditioner is treating "fresh" air inputted from outside the controlled environment. However, such combined air conditioning/dehumidification is generally inefficient. Furthermore, since some of the potential cooling power of the air-conditioner is used for dehumidification, the effective cooling capacity of the air conditioner is significantly reduced.

It is known in the art to provide dehumidification of air prior to its being cooled. In some cases, the mechanisms of the dehumidifier and the air conditioner are not integrated. In such cases, while there is an increase in the cooling capacity of the air conditioner, the overall efficiency of the system is relatively poor.

U.S. Pat. No. 4,984,434 describes an integrated system in which air to be cooled is first dehumidified by passing it through a desiccant type dehumidifier before being cooled by contact with an evaporator of an air conditioner. Regeneration of the desiccant is performed by passing the water containing desiccant over the condenser of the air conditioning system.

This system suffers from a number of limitations. Firstly, it dehumidifies all of the air being cooled. Since most of the air inputted to the dehumidifier is from the controlled space (and thus fairly dry already) the dehumidifier does not remove much water from the air and thus does not provide much cooling for the condenser. This would cause an overall increase in the temperature of the desiccant and a reduction in the efficiency of both the dehumidifier and the air-conditioner. A second problem is that such a system is not modular, namely, the dehumidifier must be supplied as part of the system. Furthermore, adding a dehumidifier to an existing air conditioning system and integrating the dehumidifier and air conditioner to form the system of this patent appears to be impossible.

Another type of dehumidifying/air conditioning system is also known. In this type of system, as described, for example in U.S. Pat. Nos. 5,826,641, 4,180,985 and 5,791,153, a dry desiccant is placed in the air input of the air-conditioner to dry the input air before it is cooled. Waste heat (in the form of the exhaust air from the condenser) from the air conditioner is then brought into contact with the desiccant that has absorbed moisture from the input air in order to dry the desiccant. However, due to the relatively low temperature of the air exiting the air conditioner, the amount of drying available from the desiccant is relatively low.

The above referenced U.S. Pat. No. 4,180,985 also describes a system using liquid desiccant as the drying medium for the dehumidifying system. Here again, the low temperature of the exhaust gas from the air conditioner reduces substantially the efficiency of the system.

Prior art desiccant based dehumidifiers generally require the movement of the desiccant from a first region in which it absorbs moisture to a second regeneration region. In the case of solid desiccants, this transfer is achieved by physically moving the desiccant from a dehumidifying station to a regeneration station, for example by mounting the desiccant on a rotating wheel, a belt or the like. In liquid desiccant systems two pumps are generally provided, one for pumping the liquid to the regeneration station and the other for pumping the liquid from the regeneration station to the dehumidifying station. In some embodiments, a single pump is used to pump from one station to the other, with the return flow being gravity fed.

The operation of standard air conditioning systems and the desiccant systems described above is illustrated with the aid of FIG. 1. FIG. 1 shows a chart of temperature vs. absolute humidity in which iso-enthalpy and iso-relative humidity curves are superimposed. Normal air conditioners operate on the principle of cooling the input air by passing it over cooling coils. Assuming that the starting air conditions are at the spot marked with an X, the air is first cooled (curve 1) until its relative humidity is 100% at which point further cooling is associated with condensation of moisture in the air. In order for there to be removal of liquid from the air, it must be cooled to a temperature that is well below a comfort zone 4. The air is heated to bring it to the comfort zone, generally by mixing it with warmer air already in the space being cooled. This excess cooling in order to achieve dehumidification is a major cause of low efficiency in such systems, under certain conditions.

Normal dehumidifier systems actually heat the air while they remove air from it. During dehumidification (curve 2) the enthalpy hardly changes, since there is no removal of heat from the system of air/desiccant. This results in an increase in temperature of both the desiccant and the air being dried. This extra heat must then be removed by the air conditioning system, lowering its efficiency.

In all dehumidifier systems mechanical power must be exerted to transfer the desiccant in at least one direction between a regenerating section and a dehumidifying section thereof. For liquid systems, pumps are provided to pump liquid in both directions between the two sections or between reservoirs in the two sections. While such pumping appears to be necessary in order to transfer moisture and/or desiccant ions between the two sections, the transfer is accompanied by undesirable heat transfer as well.

U.S. Pat. No. 6,018,954, the disclosure of which is incorporated herein by reference, describes a system in which a reversible heat pump transfers heat between desiccant liquid on a dehumidifier side of a dehumidifier and a regenerator side. The evaporator/condensers of the two sides of the heat pump are placed, in a first embodiment, so as to be in contact with liquid droplets that are removing moisture to from the air or are being regenerated by having moisture removed from them. This embodiment is substantially the same as the embodiment shown in U.S. Pat. No. 4,984,434 described above. In a second embodiment, the pump reversibly transfers heat from liquid desiccant before it is fed to a dripper in which the droplets are formed.

SUMMARY OF THE INVENTION

In accordance with a first aspect of some embodiments of the invention, the air entering the regeneration chamber is used to cool the refrigerant leaving the regeneration side. The present inventors have found that in the absence of some additional cooling of refrigerant, the system reaches a steady state at a high refrigerant temperature, at which the system is inefficient. One solution to this problem, apparently provided by existing systems utilizing U.S. Pat. No. 6,018,954, is to add water to the system, which is evaporated out of the system, cooling the system to a substantial degree. Not only does this result in a waste of water, it also results in a lowering of the efficiency of the system.

Under most conditions, this construction will result in cooled dehumidified air being generated.

In accordance with a second aspect of some embodiments of the invention, the dehumidified air leaving the dehumidifying chamber is used to remove heat from the refrigerant after it leaves the regenerator side. The result is heated dehumidified air.

In accordance with a third aspect of some embodiments of the invention, no heat is removed from the chamber normally utilized for cooling. Refrigerant is cooled both by air leaving the "dehumidifier" section and by air entering the "regenerator." This results in the air leaving the "dehumidifier" section being heated and humidified.

In accordance with some embodiments of the invention, a system in which the path of the refrigerant is selectively varied to provide one of the first second or third aspects. Alternatively, only one or two aspects are available in a given device.

An aspect of some embodiments of the invention is concerned with a combined dehumidifier/air conditioner is which a relatively low level of integration is provided. In some embodiments of the invention, heat generated by the condenser is used to remove liquid from the desiccant. However, unlike the above referenced prior art, the air conditioner condenser continues to be cooled by outside air. The heated air, which exits the air-conditioner, containing waste heat, is used to remove moisture from the desiccant.

In contrast to the prior art, in which the heated air is the sole source of energy for the regeneration of the desiccant, in exemplary embodiments of the invention, a heat pump is utilized to transfer energy from relatively cool desiccant to heat the desiccant during regeneration, in addition to the heat supplied from the exhaust of the air conditioning portion of the system. This results in a system in which the air conditioner does not have to overcool the air to remove moisture and the dehumidifier does not heat the air in order to remove moisture. This is in contrast with the prior art systems in which one or the other of these inefficient steps must be performed.

Some embodiments of the invention provide a combined dehumidifier/air-conditioner in which only "fresh", untreated air is subject to dehumidification prior to cooling by the air conditioner. This allows for both the dehumidifier and the air-conditioner to operate at high efficiency, since the dehumidifier will be operating on only wet "fresh" air and the air conditioner will be cooling only relatively dry air.

Thus, in some embodiments of the invention, the amount of waste heat generated by the air-conditioner is relatively high and the heat requirements of the dehumidifier are relatively low, since a major portion of the heat for regeneration is supplied by the heat pump.

According to an aspect of some embodiments of the invention, a simple method of integration of an air conditioner and dehumidifier is provided. In accordance with an exemplary embodiment of the invention, the air conditioner and dehumidifier are separate units without conduits for air connecting the units. However, unlike prior art unintegrated units, these embodiments provide advantages of utilizing waste heat from the air conditioner to provide regeneration energy for the dehumidifier.

According to an aspect of some embodiments of the invention, in the steady state, moisture is transferred from the dehumidifier portion of a system to the regenerator without the necessity of transferring liquid from the regenerator back to the dehumidifier.

In general, in liquid dehumidifier systems, moisture must be transferred from the dehumidifier section to the regenerator section. Since the moisture is in the form of a moisture rich (low concentration) desiccant, this is performed by pumping or otherwise transferring the desiccant. Since the desiccant also contains desiccant ions, these must be returned to the dehumidifier to maintain the desiccant ion level required for dehumidification. This is generally achieved by pumping high concentration desiccant from the regenerator to the dehumidifier section. However, in addition to pumping ions, moisture is also transferred. While the extra energy utilized for pumping may or may not be significant, the inadvertent heat transfer implicit in pumping of the moisture back to the dehumidifier is significant in reducing the efficiency of the system.

In an exemplary embodiment of the invention, reservoirs in the dehumidifier and regenerator sections are connected with a passageway that allows only limited flow. Preferably, the passageway takes the form of an aperture in a wall common to the two reservoirs.

During operation, the absorption of moisture in the dehumidifying section increases the volume in the dehumidifier reservoir, resulting in the flow, by gravity, of moisture rich (low concentration) desiccant from the dehumidifier reservoir to the regenerator reservoir. This flow also carries with it a flow of desiccant ions, which must be returned to the dehumidifier section. As indicated above, in the prior art, this is achieved by pumping ion-rich desiccant solution from the regenerator to the dehumidifier section. In an exemplary embodiment of the invention, the return flow of ions is achieved, by diffusion of ions, via the aperture, from the high concentration regenerator reservoir to the low concentration reservoir. The inventors have found that, surprisingly, diffusion is sufficient to maintain a required concentration of ions in the dehumidifier section and that the return flow is not associated with an undesirable heat transfer associated with the transfer of (hot) moisture together with the ions, as in the prior art.

In exemplary embodiments of the invention, no pumps are used to transfer desiccant between the reservoirs or between the dehumidifier section and the regenerator, in either direction.

In accordance an aspect of some embodiments of the invention, a dehumidifier is provided in which no pumping of desiccant liquid takes place between the two sides of the dehumidifier.

There is thus provided, in accordance with an exemplary embodiment of the invention, apparatus for conditioning air comprising:

a quantity of liquid desiccant;

a dehumidifier section in which air to be conditioned is brought into contact with a first portion of the liquid desiccant;

a regenerator section in which outside air is brought into contact with a second portion of the liquid desiccant; and a refrigeration system having a first heat exchanger associated with the first portion of liquid desiccant and a second heat exchanger associated with the second portion of liquid desiccant and a third heat exchanger that does not contact the liquid desiccant.

In an embodiment of the invention, the third heat exchanger is situated at an exit from the dehumidifier section of the conditioned air, such that the conditioned air is heated thereby.

In an embodiment of the invention, the third heat exchanger is situated at an entrance to the regenerator section such that outside air is heated prior to entering the regenerator.

In an embodiment of the invention, the first heat exchanger is at a lower temperature than the second heat exchanger.

In an embodiment of the invention, the refrigeration system is operative to transfer heat from the first heat exchanger to the second heat exchanger.

In an embodiment of the invention, the refrigeration system comprises a compressor and conduits between said heat exchangers configured such that heat is transferred from the first heat exchanger to the second heat exchanger.

In an embodiment of the invention, the apparatus includes a conduit for water molecules, wherein the apparatus is configured such that the air to be conditioned is dehumidified in the dehumidifier section and wherein water removed in the dehumidification is transferred to the outside air in the regenerator, said water being transferred to the regenerator via the conduit.

Optionally, no pumping of liquid desiccant between the dehumidifier and the regenerator. Alternatively, the apparatus includes a pump for pumping liquid desiccant between the dehumidifier and the regenerator.

There is further provided, in accordance with an exemplary embodiment of the invention, apparatus for conditioning air, comprising:

a quantity of liquid desiccant;

a first air-desiccant contact volume in which air to be conditioned is brought into contact with a first portion of the liquid desiccant;

a second air-desiccant contact volume in which outside air is brought into contact with a second portion of the liquid desiccant;

at least one liquid desiccant conduit providing for at least transfer of water between said first and second volumes; and a refrigeration system comprising:

having a first heat exchanger associated with the first portion of liquid desiccant;

a second heat exchanger associated with the second portion of liquid desiccant;

a third heat exchanger situated for heat exchange with said conditioned air after it leaves the first air-desiccant contact volume; and refrigerant conduits connecting elements of said refrigeration system.

In an embodiment of the invention, the apparatus includes a fourth heat exchanger. Optionally, the fourth heat exchange apparatus is situated for heat exchange with said outside air before it enters the regenerator, such that the outside air is heated thereby.

In an embodiment of the invention, the refrigerant conduits have a controllable configuration enabling a plurality of flow configurations, each said configuration providing a different path of refrigerant between the elements of the refrigerant system. Optionally, configuration is selectable by valves.

In an embodiment of the invention, the plurality of configurations includes a first configuration in which heat is transferred from the first heat exchanger to the second and third heat exchangers, thereby to heat the conditioned air. In an embodiment of the invention the second heat exchanger and/or the third heat exchanger are at a higher temperature than the refrigerant in the first heat exchanger. Optionally, for the first configuration no refrigerant flows in the fourth heat exchanger.

In an embodiment of the invention, the plurality of configurations includes a second configuration in which heat is transferred from the first heat exchanger to the second and fourth heat exchangers. In an embodiment of the invention, the refrigerant in the second heat exchanger and/or the fourth heat exchanger are at a higher temperature than the refrigerant in the first heat exchanger. Optionally, for the second configuration, no refrigerant flows in the third heat exchanger.

In an embodiment of the invention, the plurality of configurations includes a third configuration in which heat is transferred from the second heat exchanger to the third heat exchanger. In an embodiment of the invention, for the third configuration, the temperature of refrigerant in the third heat exchanger is higher than the temperature of refrigerant in the second heat exchanger. In an embodiment of the invention, heat is transferred from the second heat exchanger to the fourth heat exchanger. In an embodiment of the invention for the third configuration the temperature of refrigerant in the fourth heat exchanger is higher than the temperature of refrigerant in the second heat exchanger. Optionally, for the third configuration no refrigerant flows in the first heat exchanger.

BRIEF DESCRIPTION OF THE DRAWINGS

Particular embodiments of the invention will be described with reference to the following description of exemplary embodiments in conjunction with the figures, wherein identical structures, elements or parts which appear in more than one figure are generally labeled with a same or similar number in all the figures in which they appear, in which.

DETAILED DESCRIPTION OF EXEMPLARY EMBODIMENTS OF THE INVENTION

In some embodiments of the invention, the dehumidifiers described in applicants' PCT Applications PCT/IL97/00372, filed Nov. 16, 1997 and PCT/IL98/00552, filed 11 Nov. 1998, are used. The disclosures of these applications are incorporated herein by reference. These applications were published on May 27, 1999 as WO 99/26025 and WO 99/26026 respectively and subsequently filed as U.S. patent applications Ser. Nos. 09/554,398 and 09/554,397 respectively. In view of the potential utility of these dehumidifiers in the present invention, the dehumidifiers described therein are described in detail herein, together with embodiments of the present invention.

Figure 2:
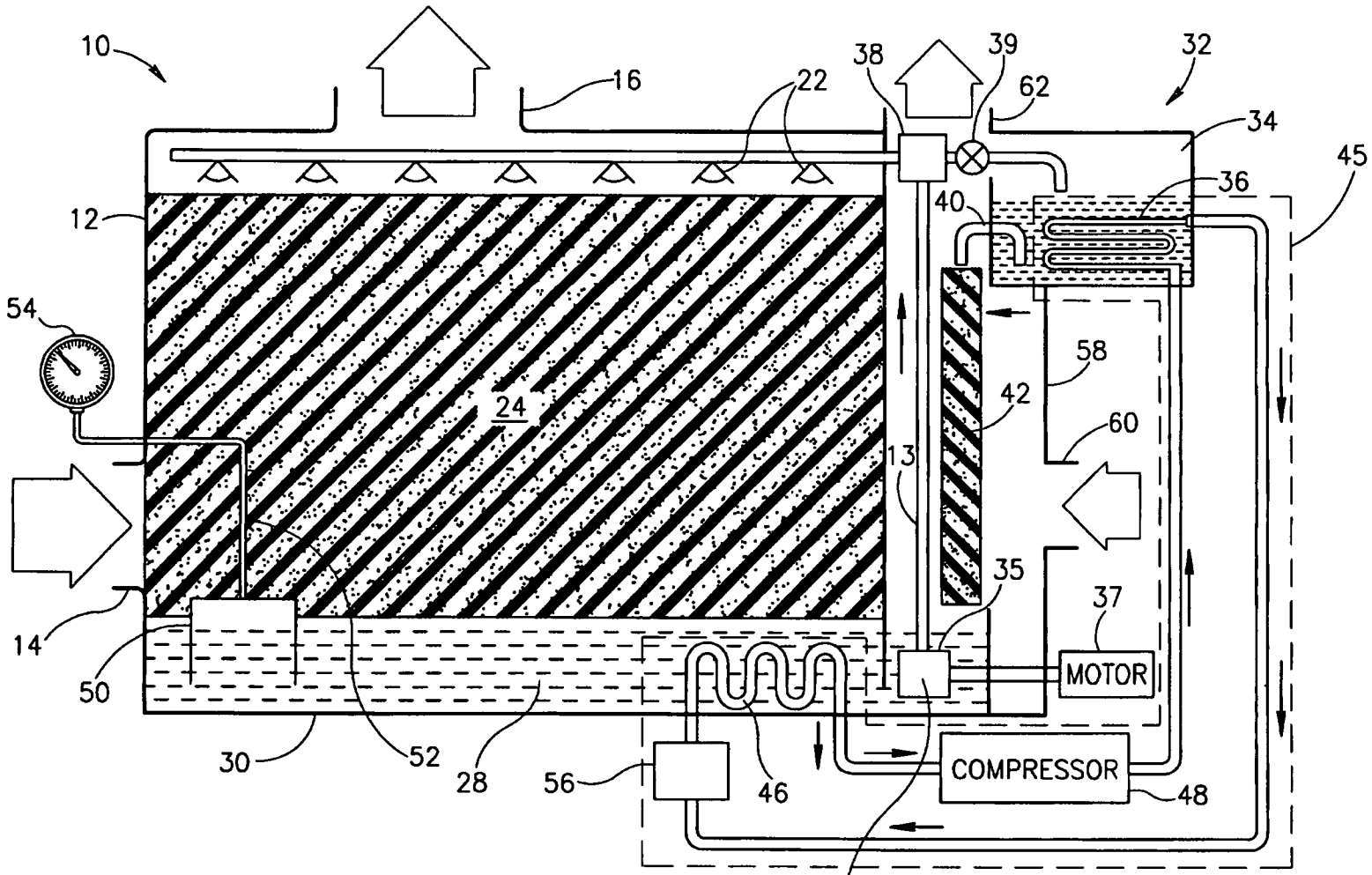
FIG. 2 schematically shows a dehumidifier unit, usable in a combined dehumidifying/air-conditioning system, in accordance with an embodiment of the invention.

Referring first to FIG. 2, a dehumidifying system 10, as described in the above referenced applications, comprises, as its two main sections a dehumidifying chamber 12 and a regenerator unit 32. Moist air enters dehumidifying chamber 12 via a moist air inlet 14 and dried air exits chamber 12 via a dry air outlet 16.

In the embodiment of FIG. 2, desiccant 28 is pumped by a pump 20 from a desiccant reservoir 30 via a pipe 13 to a series of nozzles 22. These nozzles shower a fine spray of the desiccant into the interior of chamber 12, which is filled, for example, with a cellulose sponge material 24 such as is generally used in the art for such purposes. Alternatively, the desiccant is simply dripped on the sponge material. The desiccant slowly percolates downward through the sponge material into reservoir 30. Moist air entering the chamber via inlet 14 contacts the desiccant droplets. Since the desiccant is hygroscopic, it absorbs water vapor from the moist air and drier air is expelled through outlet 16. Reservoir 30 is generally located on the bottom of chamber 12 so that the desiccant from sponge 24 falls directly into the reservoir.

In this embodiment, a pump 35 and associated motor 37 pump desiccant from an extension of reservoir 30 into pipe 13. A divider 38 receives desiccant from pipe 13 and sends part of the desiccant to nozzles 22 and part to regenerator unit 32. A valve or constriction 39 (preferably a controllable valve or constriction) may be provided to control the proportion of the desiccant which is fed to regenerator 32. If a controllable valve or constriction is used, the amount of desiccant is optimally controlled in response to the amount of moisture in the desiccant.

Chamber 34 includes a heat exchanger 36 which heats the desiccant to drive off part of the water vapor it has absorbed, thus regenerating it.

Regenerated liquid desiccant is transferred back to reservoir 30 via a pipe 40 and a tube 42 of sponge material such as that which fills chamber 12. Tube 40 is shown as being contained in a chamber 58 which has an inlet 60 and an outlet 62. Air, generally from outside the area in which the air is being modified, for example from an air conditioning exhaust, as described below, enters the chamber via inlet 60 and carries away additional moisture which is evaporated from the still hot desiccant in tube 42. The air exiting at outlet 62 carries away this moisture and also moisture which was removed from the desiccant in the regenerator. Generally, a fan (not shown) at exit 62 sucks air from chamber 58.

Alternatively or additionally, heat is transferred from the regenerated liquid desiccant to the desiccant entering or in the regenerator by bringing the two desiccant streams into thermal (but not physical) contact in a thermal transfer station (not shown). Alternatively or additionally, a heat pump may be used to transfer additional energy from the cooler desiccant leaving the regenerator to the hotter desiccant entering the regenerator, such that the desiccant returning to the reservoir is actually cooler than the desiccant which enters chamber 58.

In exemplary embodiments of the invention, a heat pump system 45 is provided which extracts heat from the desiccant in reservoir 30 to provide energy to heat exchanger 36. Optionally, this heat pump includes (in addition to exchanger 36 which is the condenser of the system) a second heat exchanger 46 in reservoir 30, which is the evaporator of the system, and an expansion valve 56. This transfer of energy results in a reduced temperature of the desiccant which contacts the air being dried thus reducing the temperature of the dried air. Second, this transfer of energy reduces the overall requirement of energy for operating the regenerator, generally by up to a factor of 3. Since the energy utilized by the regeneration process is the major energy requirement for the system, this reduction in energy usage can have a major effect on the overall efficiency of the system. Additionally, this method of heating of the desiccant in the regenerator may be supplemented by direct heating, utilizing a heating coil or waste heat from an associated air-conditioner.

It should be understood that the proportion of water vapor in the desiccant in reservoir 30 and in the regenerated desiccant must generally be within certain limits, which limits depend on the particular desiccant used. A lower limit on the required moisture level is that needed to dissolve the desiccant such that the desiccant is in solution and does not crystallize. However, when the moisture level is too high, the desiccant becomes inefficient in removing moisture from the air which enters chamber 12. Thus, in this embodiment, it may be desirable that the moisture level be monitored and controlled. It should be noted that some desiccants are liquid even in the absence of absorbed moisture. The moisture level in these desiccants need not be so closely controlled. However, even in these cases the regeneration process (which uses energy) should only be performed when the moisture level in the desiccant is above some level.

This monitoring function is generally performed by measurement of the volume of desiccant, which increases with increasing moisture. A method of measuring the volume of liquid in the reservoir is by measurement of the pressure in an inverted vessel 50 which has its opening placed in the liquid in the reservoir. A tube 52 leads from vessel 50 to a pressure gauge 54. As the volume of desiccant increases from the absorption of moisture, the pressure measured by gauge 52 increases. Since the volume of desiccant in the dehumidifier chamber and in the regenerator is fairly constant, this gives a good indication of the amount of desiccant and thus of the amount of moisture entrained in the desiccant. When the moisture level increases above a preset value, the heat in chamber 34 is turned on. Optionally, when the moisture level falls below some other, lower preset value, the heater is turned off.

Other factors which may influence the cut-in and cut-out points of the regeneration process are the temperature of the dry air, the regeneration efficiency and the heat pump efficiency. In some embodiments of the invention, it may be advisable to provide some direct heating of desiccant in the regeneration process.

In other embodiments, heat pumps or other heat transfer means (not shown for simplicity) are provided to transfer heat from the dried air exiting chamber 12 and or from the heated moist air leaving regenerator chamber 34, to heat the desiccant on its way to or in chamber 34. If heat pumps are used, the source of the heat may be at a temperature lower than the desiccant to which it is transferred.

It should be understood that cooling of the desiccant in the reservoir can result in dried air leaving the dehumidifier which has the same, or optionally a lower temperature than the moist air entering the dehumidifier, even prior to any additional optional cooling of the dry air. This feature is especially useful where the dehumidifier is used in hot climates in which the ambient temperature is already high.

As indicated above, one of the problems with dehumidifier systems is the problem of determining the amount of water in the desiccant solution so that the dehumidifier solution water content may be kept in a proper range.

Figure 3A:
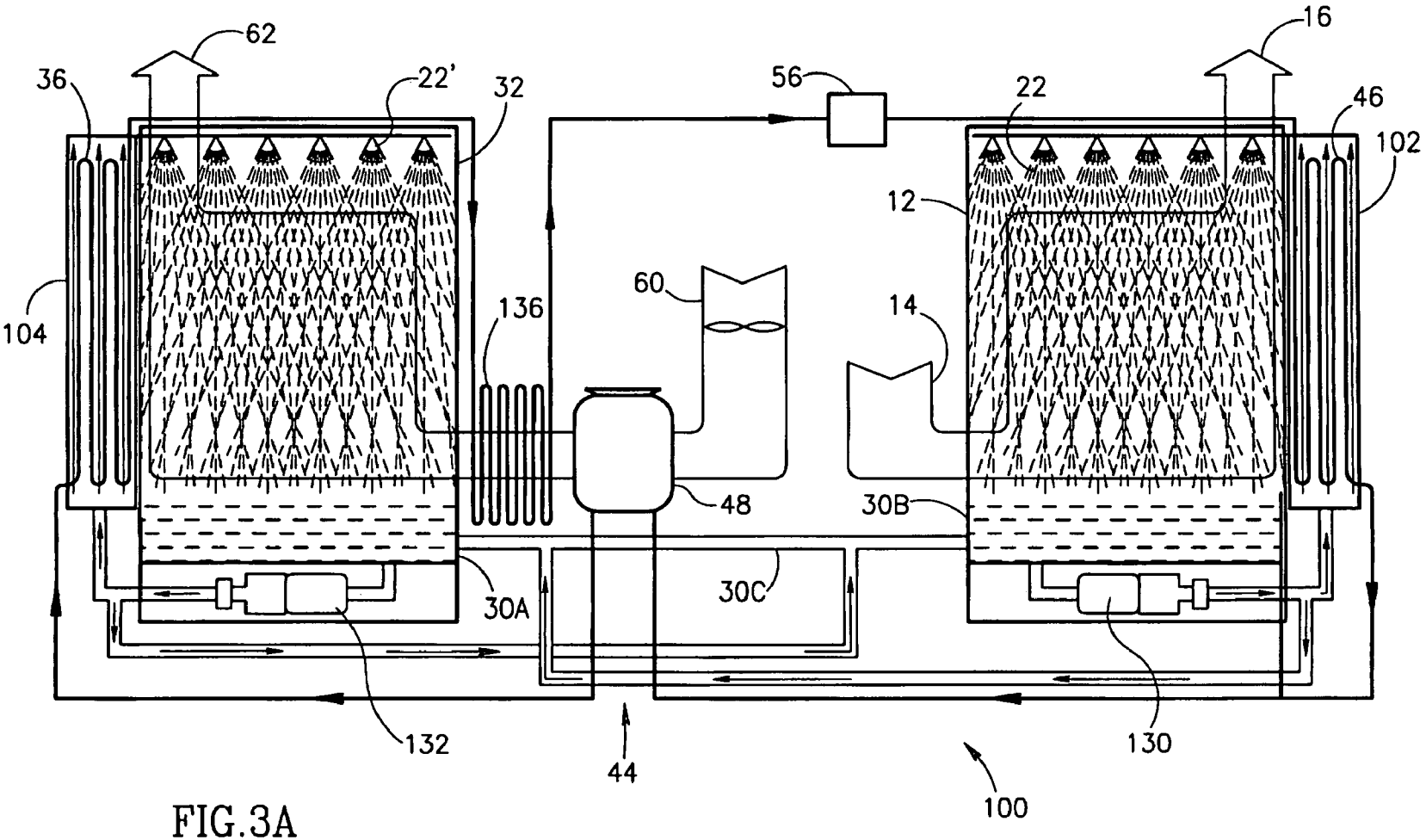
FIG. 3A schematically shows a second dehumidifier unit, usable in a combined dehumidifying conditioning system, in accordance with an alternative embodiment of the invention, in which air entering the regenerator cools refrigerant leaving the regenerator.

A self regulating dehumidifier 100, that is self regulating with respect to water content of the desiccant solution and thus does not require any measurement of the volume or water content of the desiccant solution, is shown in FIG. 3A. Furthermore, the dehumidifier operates until a predetermined humidity is reached and then ceases to reduce the humidity, without any controls or cut-offs.

Dehumidifier 100 is similar to dehumidifier 10 of FIG. 2, with several significant differences. First, the system does not require any measurement of water content and thus does not have a volumetric measure for the desiccant. However, such a measurement may be provided as a safety measure if the solution becomes too concentrated.

Second, the heat pump transfers heat between two streams of desiccant solution being transferred from reservoir 30 (which is conveniently divided into two portions 30A and 30B connected by pipes 30C), namely a first stream being pumped to nozzles 22 by a pump system 130, via a conduit 102 and a second stream being pumped to regenerator unit 32 by a pump system 132, via a conduit 104.

In an exemplary embodiment of the invention, pipes 30C (including the bypass pipes shown) are designed so that its major effect is to generate a common level of the solution in portions 30A and 30B. In general, it is desirable that the two reservoir portions have different temperatures. This necessarily results in different concentrations of desiccant. However, it is considered generally desirable to provide some mixing between the sections, by some pumping via the bypass pipes shown so as to transfer moisture from one portion to the other. In some embodiments of the invention a temperature differential of 5° C. or more is maintained, optionally, 10° C. or more or 15° C. or even more. Thus, in an exemplary embodiment of the invention, reservoir portion 30A is at a temperature of 30° C. or more and reservoir portion 30B is at a temperature of 15° C. or less.

In FIG. 3A, a different construction for regenerator unit 32 is shown, which is similar to that of the dehumidifier section. Furthermore, in FIG. 3A, neither section has a cellulose sponge material. Such material may be added to the embodiment of FIG. 3A or it may be omitted from the embodiment of FIG. 2 and replaced by the spray mechanism of FIG. 3A.

In some embodiments of the invention, applicable to either FIG. 2 or 3A, spray nozzles are not used. Rather, the spray nozzles are replaced by a dripper system from which liquid is dripped on the cellulose sponge to continuously wet the sponge. Such systems are shown, for example in the above referenced PCT/IL98/00552.

Returning to FIG. 3A, heat pump system 45 extracts heat from the desiccant solution in conduit 102 and transfers it to the desiccant in conduit 104. Heat pump system 45 contains, in addition to the components contained in the embodiment of FIG. 2, an optional heat exchanger 136 to transfer some of the heat from the refrigerant leaving heat exchanger 104 to the regenerating air. Optionally, the compressor is also cooled by the regenerating air. However, when the air is very hot, additional air, not used in the regenerator, may be used for cooling the compressor and the refrigerant. Alternatively, only such air is used for such cooling.

Cooling the refrigerant and/or compressor in this manner results in the removal of additional air from the system, which allows the refrigerant system to operate at a lower temperature. Operating the system without such additional cooling, may result in the refrigerant being too hot in the steady state to operate properly.

The resultant heating of the air entering the regenerator increases the ability of the air to remove moisture from the desiccant. Heat pump 45 is set to transfer a fixed amount of heat. In an embodiment of the invention, the humidity set point is determined by controlling the amount of heat transferred between the two streams.

Consider the system shown in FIG. 3A, with the air entering dehumidifier chamber 12 at 30° C. and 100% humidity. Assume further that the amount of liquid removed from the air reduces its humidity to 35% without reducing the temperature. In this situation, the amount of heat transferred between the streams of desiccant solution would be equal to the heat of vaporization of the water removed from the air, so that the temperature of the desiccant solution falling into reservoir 20 from chamber 12 is at the same temperature as that which enters it, except that it has absorbed a certain amount of moisture from the air.

Assume further, that the regenerator is set up, such that at this same temperature and humidity, it removes the same amount of water from the desiccant solution. This may require an input of heat (additionally to the heat available from the heat pump).

Further assume that the air entering the dehumidifier chamber has a lower humidity, for example 80%. For this humidity, less liquid is removed (since the efficiency of water removal depends on the humidity) and thus, the temperature of the desiccant solution leaving the dehumidifier chamber also drops. However, since less water enters the desiccant solution from the dehumidifier chamber, the amount of water removed from the solution in the regenerator also drops. This results in a new balance with less water removed and the desiccant solution at a lower temperature. A lower temperature desiccant results in cooler air. Thus, the temperature of the exiting air is also reduced. However, the relative humidity remains substantially the same. It should be understood that a reduction of input air temperature has substantially the same effect.

Generally, the system is self regulating, with the dehumidifying action cutting off at some humidity level. The humidity level at which this takes place will depend on the capacity of the solution sprayed from nozzles 22 to absorb moisture and the ability of the solution and on the capacity of the solution sprayed from nozzles 22' to release moisture.

In general as the air at inlet 14 becomes less humid (relative humidity) the dehumidifier becomes less able to remove moisture from it. Thus, the solution is cooled on each transit through the conduit 102 and the percentage of desiccant in the solution in 30B reaches some level. Similarly, as less moisture is removed from the air, the solution in 30A becomes more concentrated and less moisture is removed from it (all that happens is that it gets heated). At some point, both removal and absorption of moisture by the solution stop since the respective solutions entering the dehumidifier and regenerator chambers are in stability with the air to which or from which moisture is normally transferred.

It should be understood that this humidity point can be adjusted by changing the amount of heat transferred between the solutions in conduits 102 and 104. If greater heat is transferred, the desiccant in the dehumidifying chamber is cooler and the desiccant in the regeneration chamber is hotter. This improves the moisture transfer ability of both the dehumidifying chamber and the regenerator and the humidity balance point is lowered. For less heat pumped from the dehumidifier side to the regenerator side, a higher humidity will result. In addition, the set-point will depend somewhat on the relative humidity of the air entering the regenerator.

The device shown in FIG. 3A and described above, results in dry, generally cooler air leaving outlet 16 than entering inlet 14.

Figure 3B:
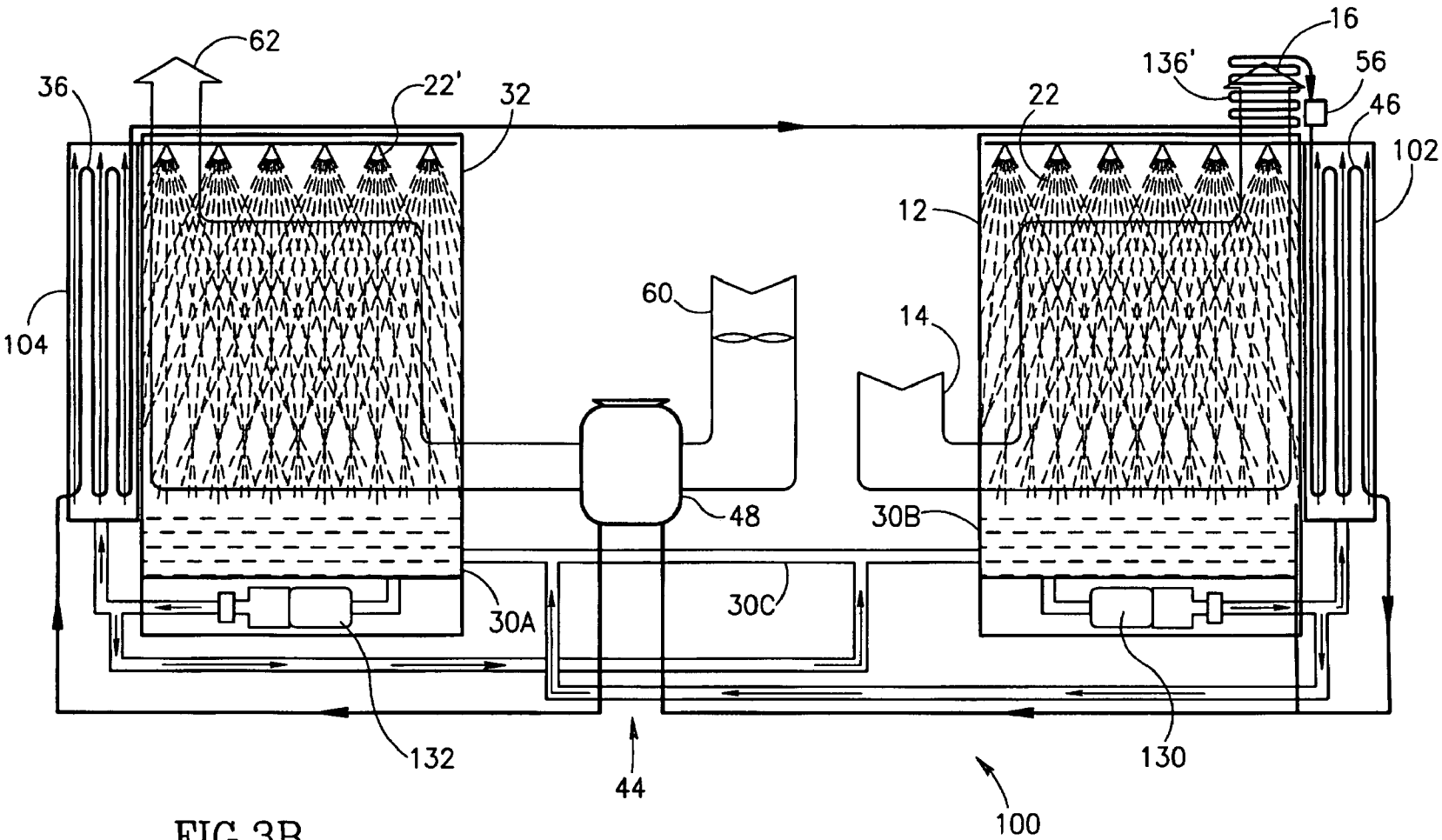
FIG. 3B schematically shows a third dehumidifier unit, usable in a combined dehumidifying/air conditioning system, in accordance with an alternative embodiment of the invention, in which air leaving the dehumidifier cools refrigerant leaving the regenerator.

Sometimes, it is desired that the air leaving outlet 16 be warmed as well as dehumidified. In order to achieve this effect, the device of FIG. 3B can be used. The device of FIG. 3B is the same as the device of FIG. 3A, except that heat exchanger 136 at the input of the regenerator is moved to the output of the dehumidifier and denoted 136'. The device shown in FIG. 3B produces dehumidified, warmed air.

Figure 4A:
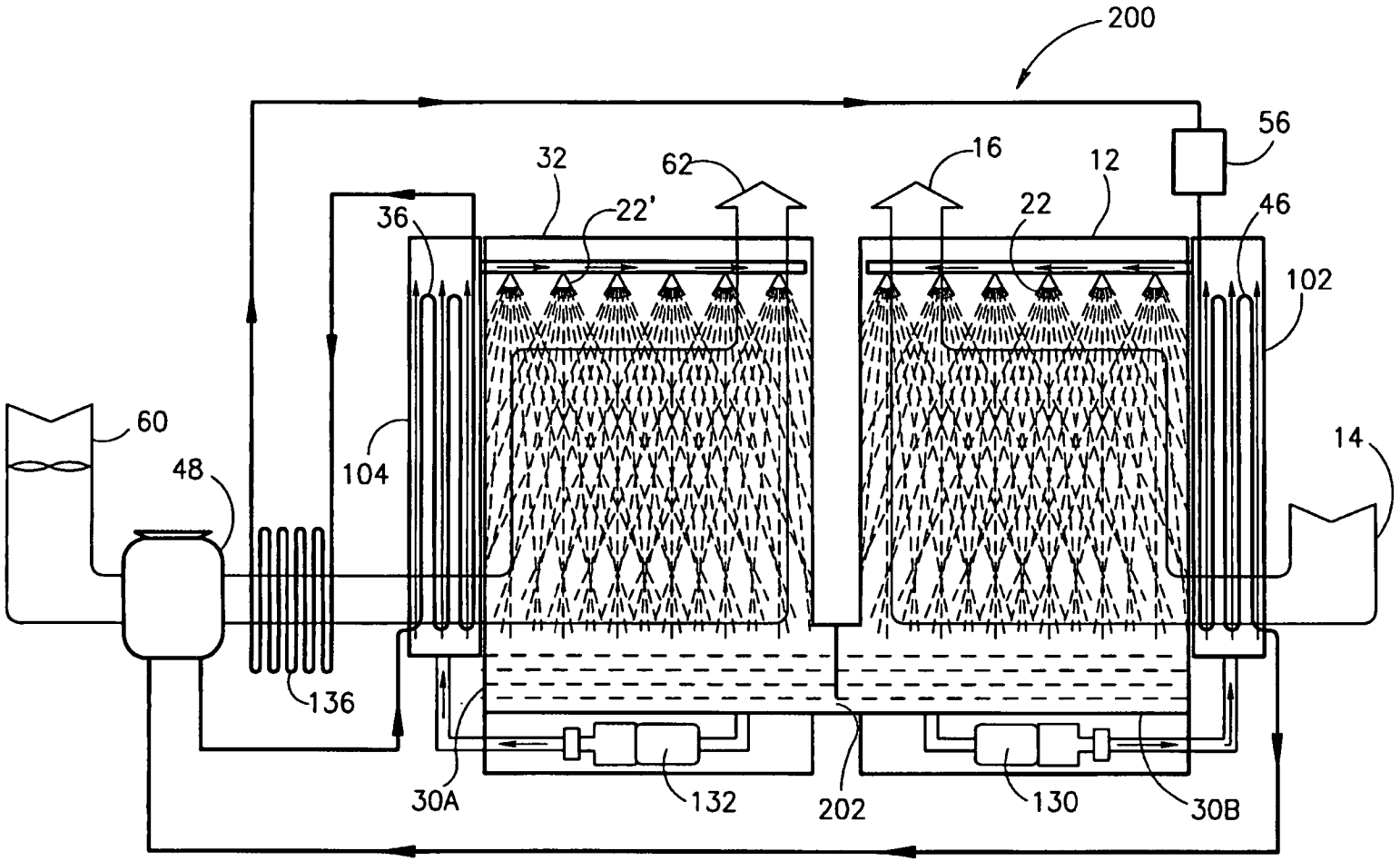
FIG. 4A schematically shows a dehumidifier unit system, in accordance with an exemplary embodiment of the invention, in which air entering the regenerator cools refrigerant leaving the regenerator.
Figure 4B:
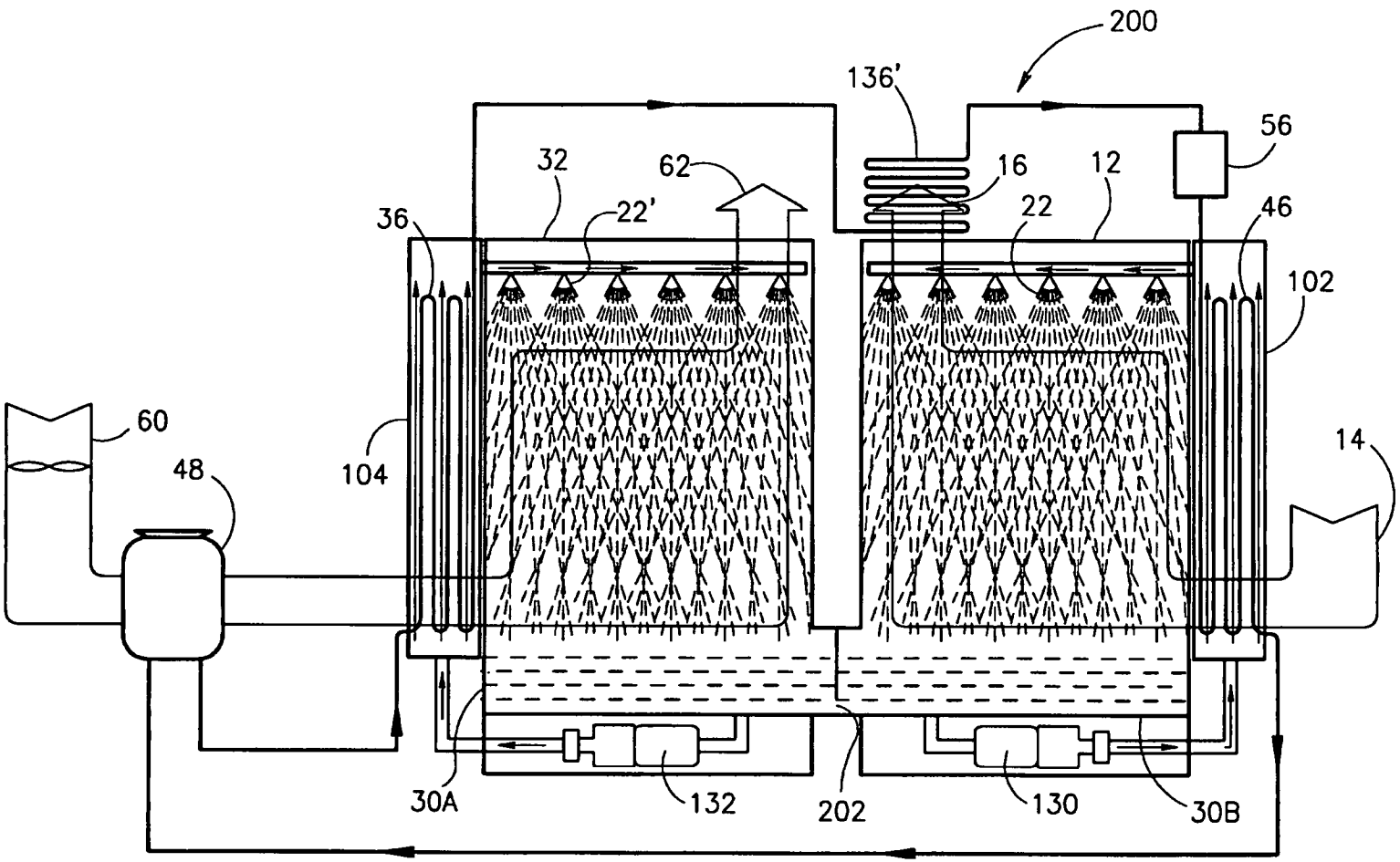
FIG. 4B schematically shows a dehumidifier unit system, in accordance with an alternative embodiment of the invention, in which air leaving the dehumidifier cools refrigerant leaving the regenerator.

FIGS. 4A and 4B show another dehumidifier 200, in which no pumping of desiccant is required. Except as described below, it is generally similar to the dehumidifiers of FIGS. 3A and 3B, except that there is no pumping of the desiccant liquid between the sumps 30A and 30B. (FIGS. 4A and 4B do have a somewhat different layout from those of FIGS. 3A and 3B.) The inventors have surprisingly found that an appropriately shaped and sized aperture, such as aperture 202 connecting the two sumps provides a suitable way to provide required transfer between the two sumps.

In general, in a liquid desiccant system such as that of FIGS. 3 or 4, sump 30B (the sump of dehumidifying chamber 12) accumulates additional moisture over sump 30A (the sump of regenerator 32). This additional moisture must be transferred to sump 30A or directly to the regenerator in order to remove the moisture from the desiccant. In addition, the concentration of desiccant in sump 30B is much lower than that in sump 30A, and the proportion of desiccant in sump 30A must be continually increased so that the efficiency and drying capacity of regeneration is kept high.

One way of coping with this problem is to use a single sump, as in the device of FIG. 2. However, this results in substantially the same temperature for the desiccants used from dehumidification and that being regenerated. This results in a loss of efficiency.

In the dehumidifiers of FIGS. 3A and 3B, the sumps are kept separate and pumps are used to pump the liquid from one sump to the other. This allows for a temperature differential to be maintained between the sumps and thus between the regenerator and the dehumidifying sections. As indicated above, pipe 30C is so constructed that only minimal liquid transfer takes place between the sumps, preserving a relatively high temperature differential.

However, the transfer of liquid in FIGS. 3A and 3B is inefficient, since desiccant is inevitably transferred from the dehumidifying section to the regenerator and moisture is transferred to the dehumidifying section from the regenerator. In addition, in order to preserve the temperature differential, an undesirable balance of moisture and desiccants in the sumps is also preserved, even if it is reduced by the pumping. (The desiccant concentration is higher in the regenerator sump than in the sump of the dehumidifier section.) Both these effects result in reduced efficiency of both sections of the dehumidifier.

The apparatus of FIGS. 4A and 4B solves this problem by transferring the desiccants and salts by diffusion between the liquids in the sumps, rather than by pumping desiccant solution between the sumps. Thus, on a net basis, only desiccant salt ions are transferred from the regenerator sump to the pumps, and only moisture, on a net basis is transferred from the dehumidifier sump to the regenerator sump.

In exemplary embodiments of the invention, aperture 202 is provided between sumps 30A and 30B. The size and positioning of this aperture is chosen to provide transfer of ions of water and desiccant salt between the sumps without an undesirable amount of thermal transfer, especially from the hotter to the cooler reservoir. In practice, the size of the aperture may be increased, such that at full dehumidification, the flow of heat between the sumps is at an acceptable level. When the hole is too large, there appears to be a flow of heat from the hotter regenerator reservoir to the cooler dehumidifier reservoir. Undesirable heat flow may be determined by measuring the temperature near the hole and comparing it to the temperature in the bulk solution in the sump. When the hole is too large, there will generally be a significant thermal flow from sump 30B to sump 30A. When the hole size is reduced too much, the transfer of ions is reduced and the overall efficiency is reduced.

It should be understood that the embodiment of FIGS. 4A and 4B may provide temperature differentials of the same order (or even greater) than those of FIGS. 3A and 3B.

While the size may be empirically determined as described above, in an exemplary, but not limiting, experimental systems the aperture is rectangular, with rounded corners having a width of 1–3 cm (preferably about 2 cm) and a height of 1–10 cm, depending on the capacity of the system. Preferably, the hole is placed at the bottom of the partition between the reservoirs, so as to take advantage of the higher salt concentration in the regenerator reservoir at the bottom of the reservoir. The additional height allows the system to operate even under extreme conditions when some crystallization (which may block the aperture) occurs at the bottom of the reservoir. Alternatively, the aperture is defined by a series of heightwise distributed holes. Alternatively, the aperture is defined by a slit at the bottom and spaced holes above. In these situations, the amount of diffusion of salt ions is dependent on the amount of liquid in the system which is, in turn, dependent on the humidity. When there is more moisture in the system, the liquid increases and the flow of water and ions (by diffusion in the reverse direction) also increases.

It should be understood that the dimensions and positioning of the aperture or apertures is dependent on many factors and that the example given above was determined experimentally.

Some points about the dehumidifier of FIGS. 4A and 4B should be noted. There is a net flow of moisture, via aperture 202 from reservoir 30B to reservoir 30A when the system has reached a steady state and the air conditions are constant. In fact, since the dehumidifier section is continuously adding moisture to the desiccant and the regenerator is continuously removing moisture from it, this is to be expected. During operation, the concentration of ions in reservoir 30A is generally higher than that in reservoir 30B. This will be true, because the desiccant in 30A is continuously being concentrated and that in 30B is continuously be diluted. This difference in concentration causes a diffusive flow of ions from reservoir 30A to reservoir 30B, via aperture 202. However, this is balanced by the flow of ions from reservoir 30B to 30A caused by the flow of solution in this direction. This results in no net flow of ions from one reservoir to the other. During periods of changing conditions of the input air, there may be a transient net flow of ions.

During a start-up transient, the total amount of liquid desiccant solution increases by the addition of moisture removed from the air. This means that during this transient period there is a net transfer of desiccant ions from reservoir 30B to 30A, which results in the concentration of desiccant in reservoir 30B being lower than that in reservoir 30A during steady state.

In a practical system, during steady state, the temperature of the desiccant in reservoir 30B is 15° C. and the concentration is 25% by weight of salt. Optionally, the salt used is lithium chloride, since this is a stable salt with relatively high desiccating capacity. Lithium bromide is an even better desiccant, but is less stable; it too can be used. Other usable salts include magnesium chloride, calcium chloride and sodium chloride. Other liquid desiccants, as known in the art may also be used.

The temperature and concentrations for reservoir 30A is 40° C. and 35%. It should be understood that the concentration in reservoir 30A can be higher (without crystallization) than that in reservoir 30B due to the higher temperature of the desiccant. When the system stops, the concentrations and temperatures soon equalize. Of course, these numbers will vary widely depending on the temperature and humidity of the air being conditioned and the "set point" of the dehumidifier (as determined by the heat pump setting), among other factors.

In the exemplary embodiment of the invention, there is no transfer of materials between the reservoirs, except via the aperture and no pumps are used for transfer. It is also noted that where no pumps are used to transfer the liquid from one side to the other, if a steady state exists, there must be a null net flow of ions across the aperture.

Figure 4C:
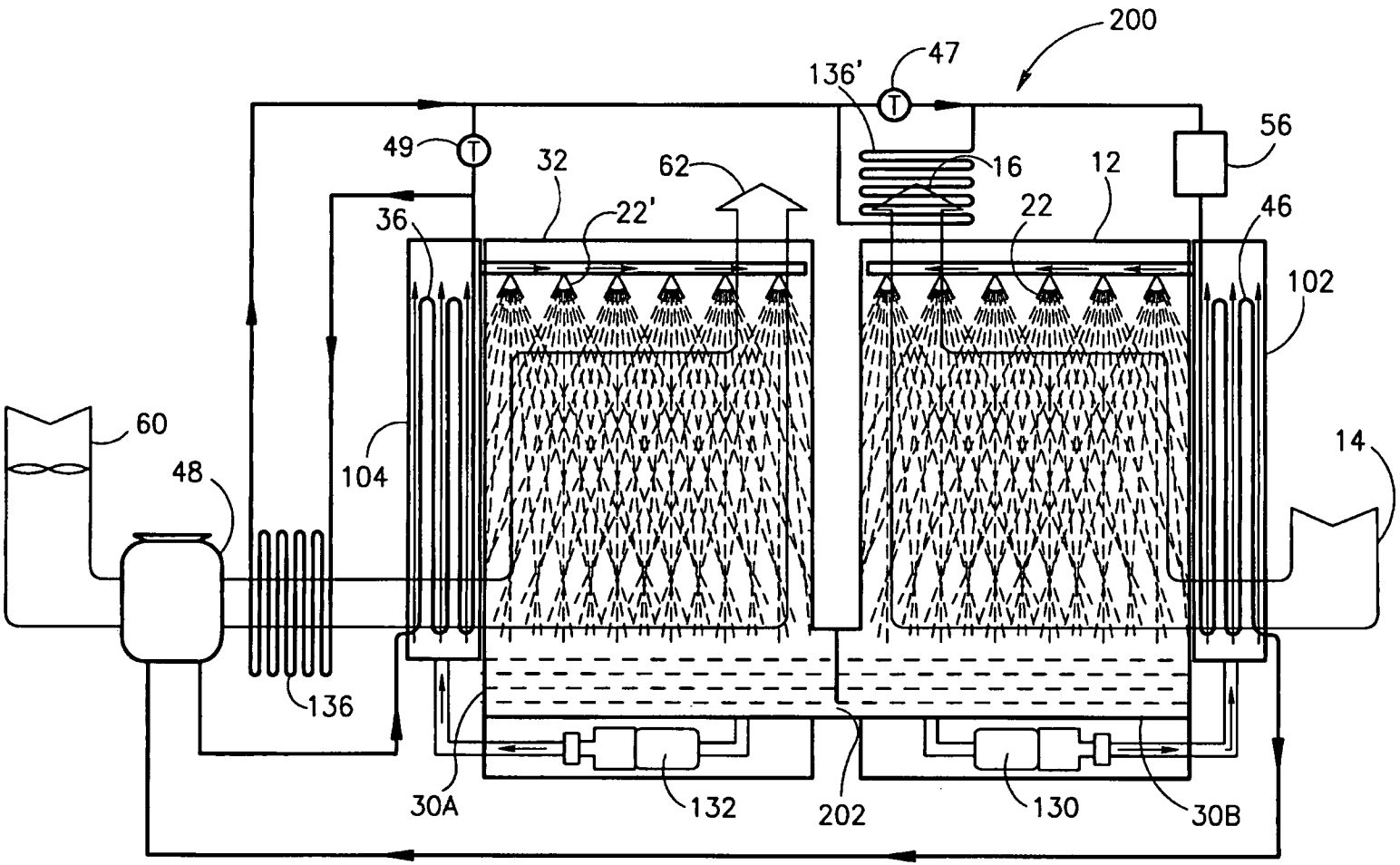
FIG. 4C schematically shows a dehumidifier unit system, in accordance with an alternative embodiment of the invention, switchable between a first state in which air leaving the dehumidifier cools refrigerant leaving the regenerator and a second state in which air entering the regenerator cools refrigerant leaving the regenerator.

FIG. 4C shows a system in which either the embodiment of FIG. 4A or 4B can be provided by switching valves 47 and 49 from open to closed states. For example, if valve 47 is open (i.e., it allows flow) and valve 49 is closed (no flow), the embodiment of FIG. 4A will result. If valve 47 is closed and valve 49 is open, the embodiment of FIG. 4B will result. Thus, if these valves are electrical or hydraulic, the apparatus shown in FIG. 4C can be easily switched between a cooling dehumidifier state and a heating dehumidifier state, both with high efficiency.

It should be understood that to avoid duplication the methodology of FIG. 4C is shown only for the embodiment of FIG. 4. It should be understood that it can also be applied to the dehumidifier of FIGS. 3A and 3B and also to that of FIG. 2. It should also be understood that the valve layout shown in FIG. 4C is exemplary only. A large number of different valve layouts could be used for the switching of the path of the refrigerant in the manner shown in FIG. 4C.

Figure 5A:
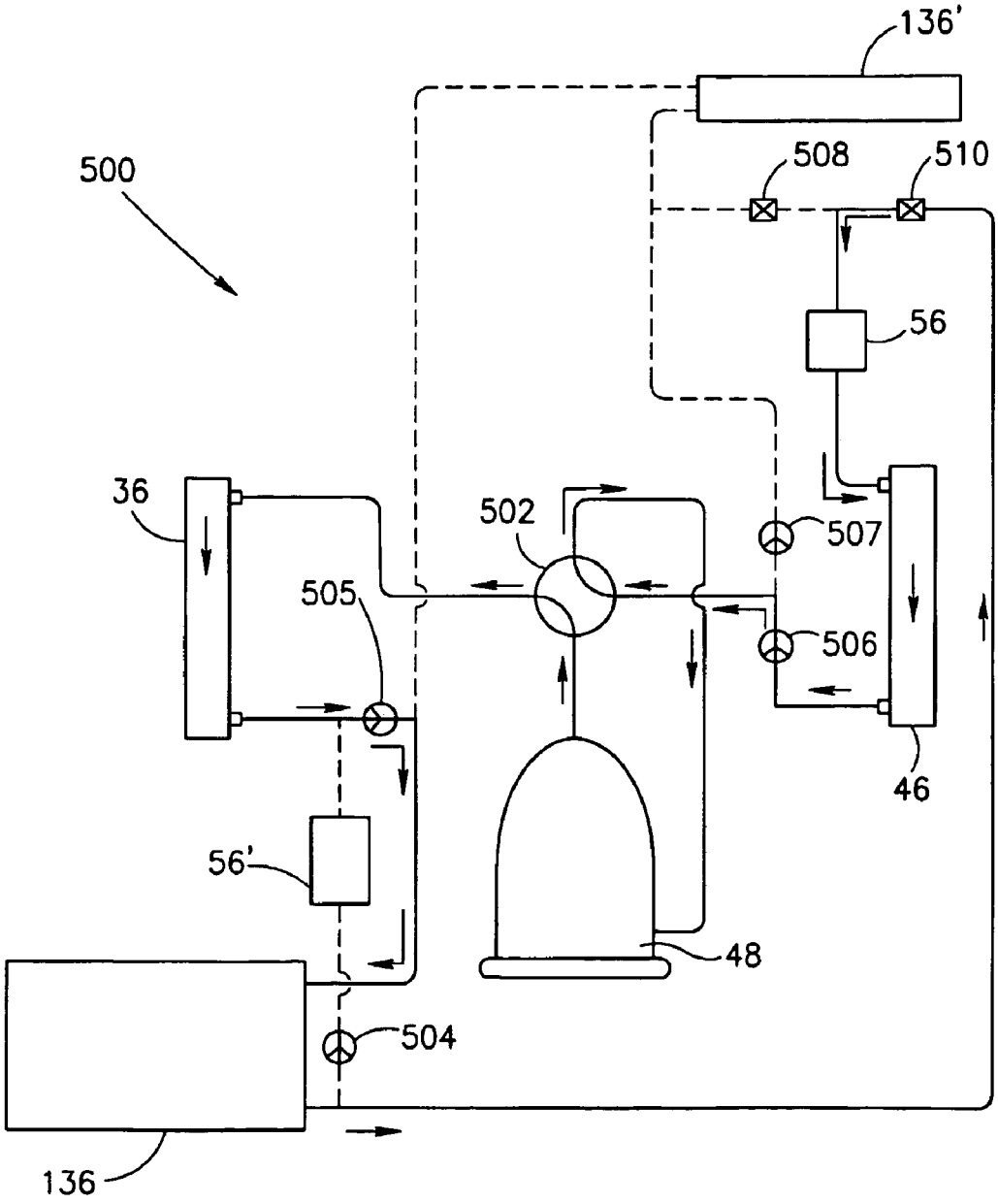
FIG. 5A shows a first switching configuration of a dehumidifier according to an embodiment of the invention, in which cooled, dehumidified air is produced.
Figure 5B:
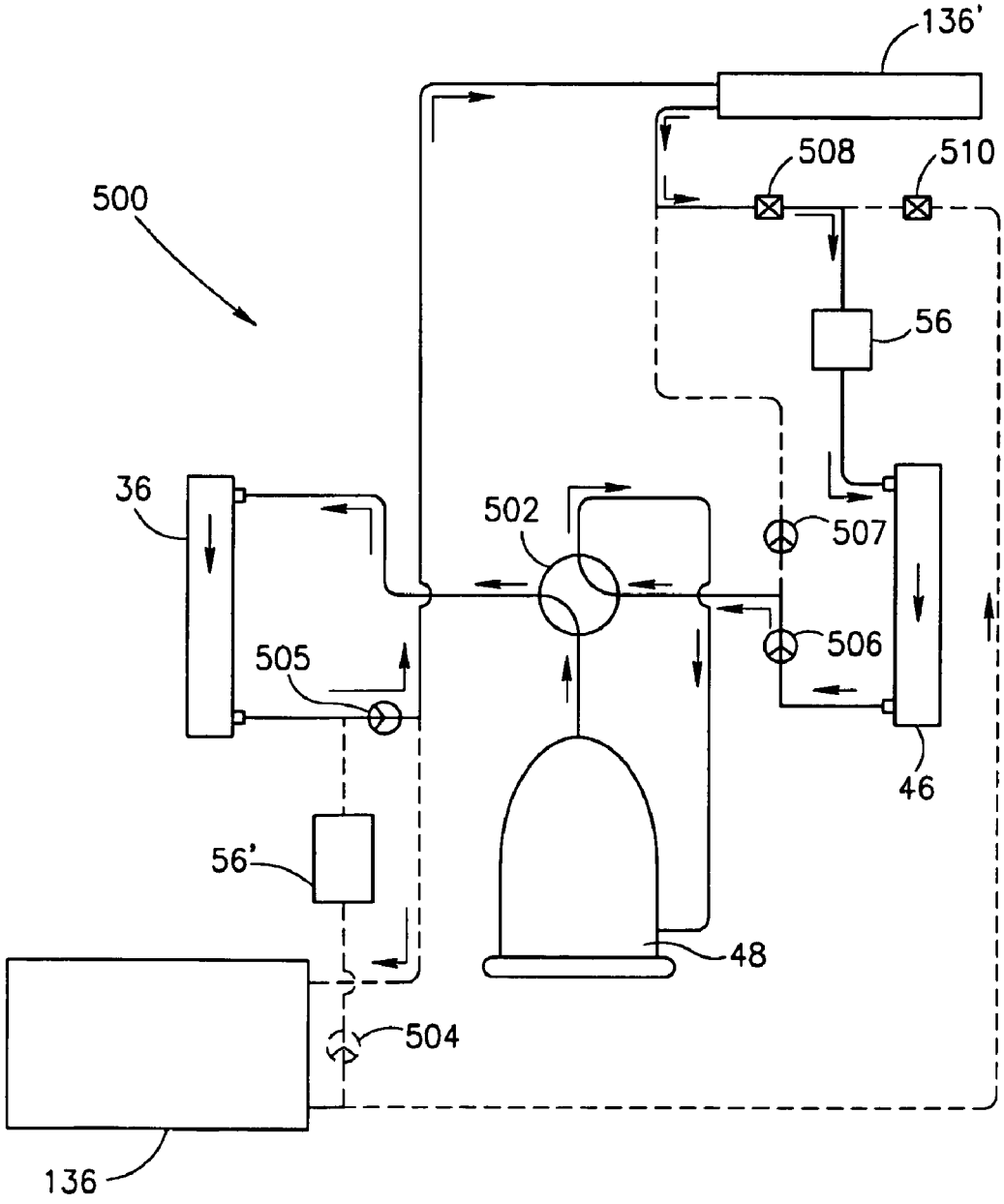
FIG. 5B shows a second switching configuration in which warm dehumidified air is produced.
Figure 5C:
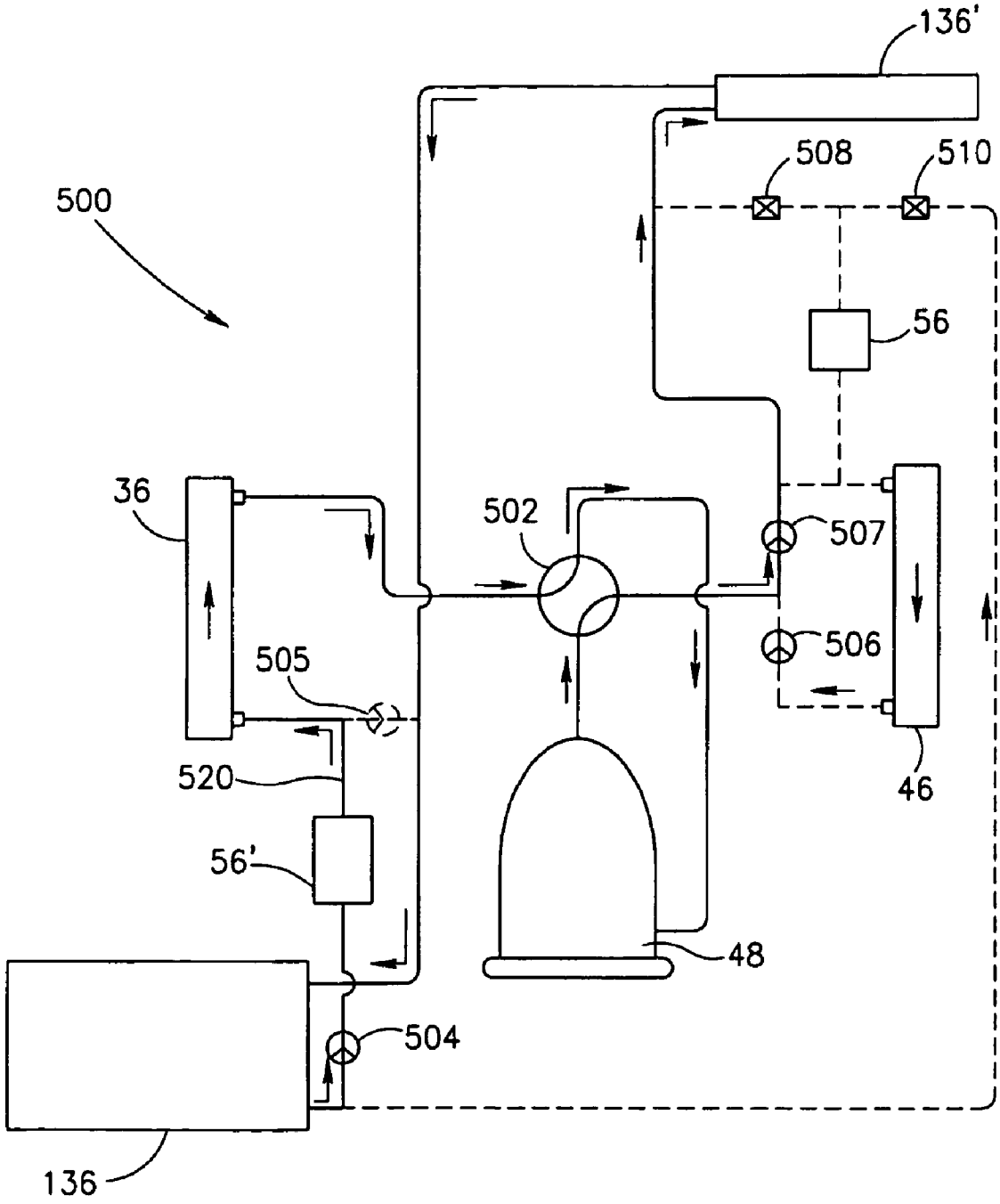
FIG. 5C shows a third switching configuration in which warm humidified air is produced.

FIGS. 5A–5C show three states of a refrigerant system 500, in accordance with an embodiment of the invention. These figures show an alternative way of connecting the elements of the system of FIG. 4C to provide a system in which three states are available, namely, cooling and dehumidification, heating and dehumidification and heating and humidification. FIGS. 5A–C do not show all of the elements of FIG. 4C, however, the common elements are indicated with identical reference numbers. Additional elements, as indicated below, are also shown.

The basic building blocks of the refrigerant system that are common to FIGS. 4C and 5A–5C are compressor 48, heat exchangers 136 and 136', heat exchangers 36 and 46 and expansion valve 56. Valves 49 and 47 and the refrigerant piping shown in FIG. 4C are replaced by the structure shown in FIGS. 5A–5C. The rest of the system and the position of the above mentioned components in FIG. 4C need not be changed.

Refrigerant system 500, comprises, in addition to the components shown in FIG. 4C, a series of pipes for refrigerant, a switch 502, a second expansion valve 56', four on-way valves 504–507 and two switchable stop valves 508 and 510. In each of the Figs. the portions of the piping in which there is no flow are shown as dashed lines. In addition, the direction of flow is shown throughout. As in the above explanation, open indicates flow is allowed and closed indicates that it is not.

FIG. 5A shows a configuration which is functionally the same as that shown in FIG. 4A. In this embodiment switch 508 is closed and switch 510 is open, so that there is no flow of refrigerant through heat exchanger 136' and refrigerant does flow through heat exchanger 136. This results in cooling and dehumidification of the air being conditioned, as described above. In this configuration, heat exchanger 46 is cold and heat is transferred therefrom to heat exchangers 36 and 136, which are hotter.

FIG. 5B shows a second configuration which is functionally the same as that shown in FIG. 4B. In this embodiment switch 510 is closed and switch 511 is open, so that there is no flow of refrigerant through heat exchanger 136 and refrigerant does flow through heat exchanger 136'. This results in heating and dehumidification of the air being conditioned, as described above. In this configuration, heat exchanger 46 is cold and heat is transferred therefrom to heat exchangers 36 and 136', which are hotter.

In FIG. 5C, the position of switch 502 is changed and both switches 508 and 510 are closed. In this embodiment, refrigerant flows in line 520 and expansion valve is operative. There is no flow in heat exchanger 46. The refrigerant system then consists of heat exchangers 36, 136 and 136'. The conditioned air is passed through the "dehumidifying chamber" 12. However, in the absence of cooling of this chamber, moisture is added to the air rather than removed from it. The moisturized air passes though heat exchanger 136' so that heated humidified air results. Heat exchanger 36 acts to cool the desiccant in the "regenerator" 32 so that it absorbs moisture from the outside air. This moisture is transferred to the "dehumidifying chamber" 12 and from there to the conditioned air. In effect, the function of heat exchanger is reversed over that in the configurations of FIGS. 5A and 5B. It may be noted that in this configuration, the coolest heat exchanger is heat exchanger 36, from which heat is transferred to heat exchangers 136 and 136'. It should be further noted that heat exchanger 136 appears to act against the functionality of heat exchanger 36, which removes heat from the outside air. However, in effect, this process serves to return, to whatever extent possible, heat to heat exchanger 136'. In addition, as with all the external heat exchangers, it is operative to remove as much heat as possible from the refrigerant before the refrigerant is fed to the expansion valve.

Figure 1:
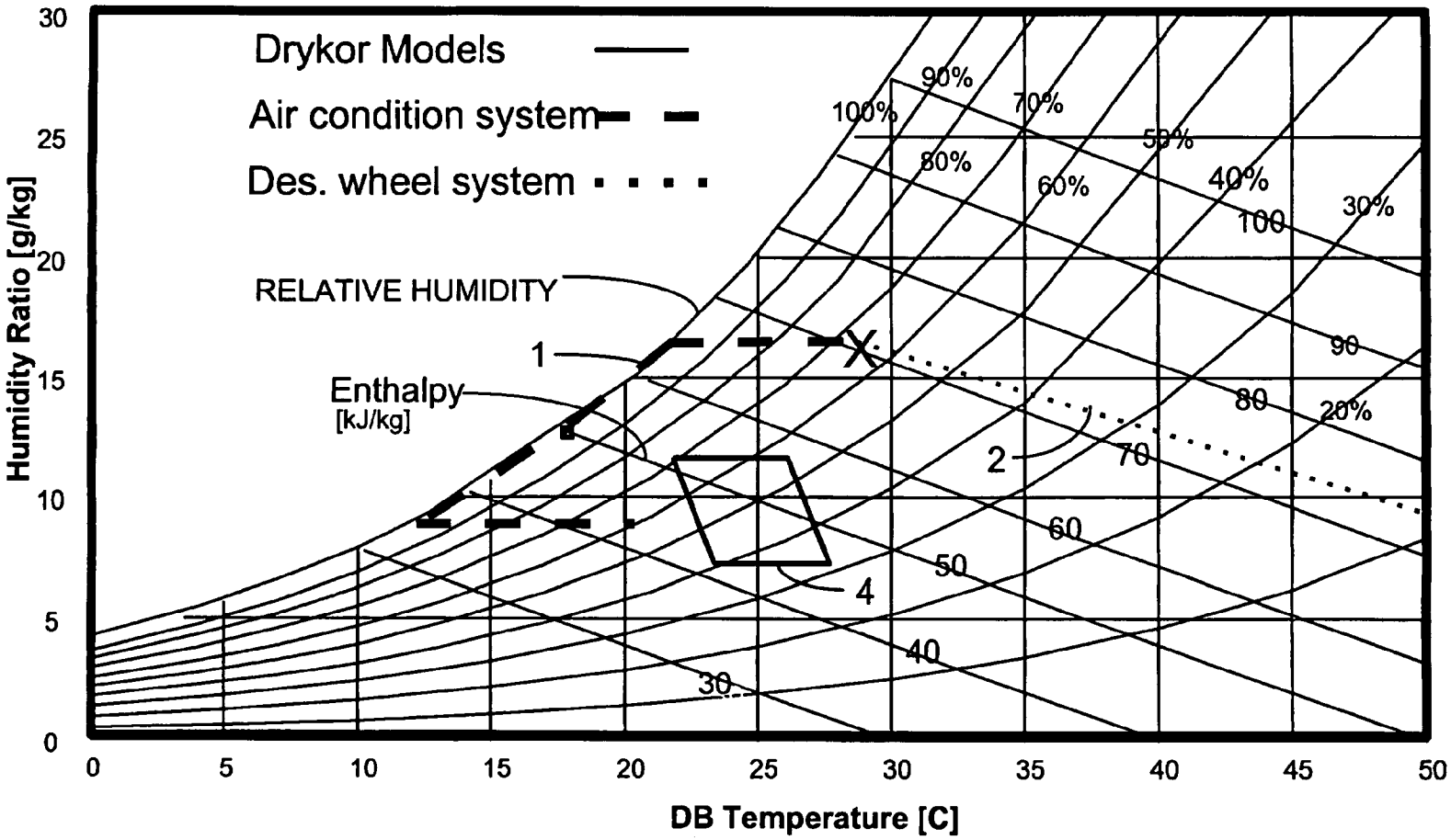
FIG. 1 shows cooling and dehumidification curves for conventional air conditioning and dehumidification systems.
Figure 6:
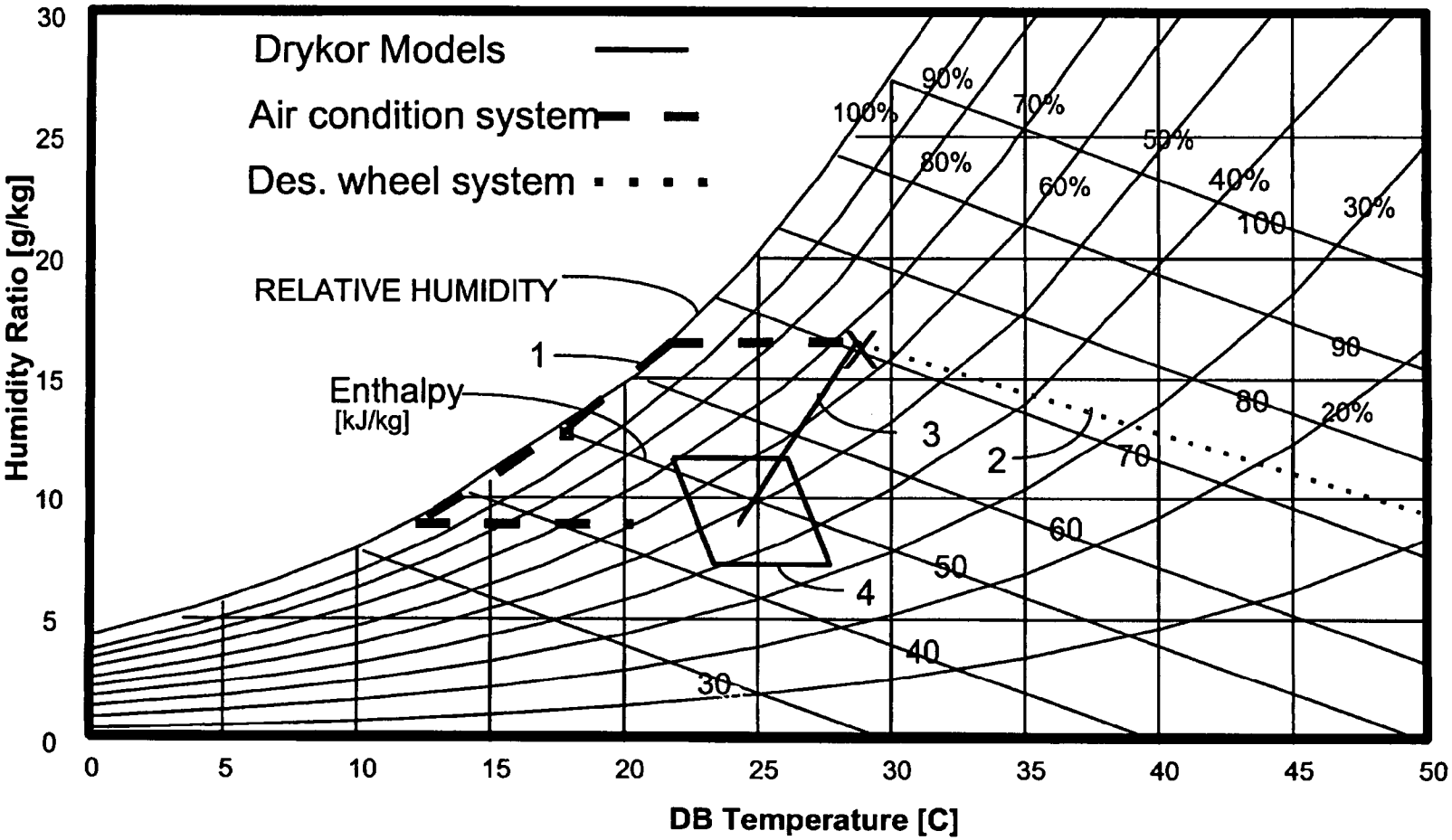
FIG. 6 shows the dehumidification curves for some of the systems described with respect to FIGS. 2–4, together with those for conventional air conditioning and dehumidification systems.

FIG. 6 shows a diagram, similar to that of FIG. 1, except that the desiccant systems of FIGS. 2–4 are represented by a line 3. This shows that the cooling of the desiccant in the dehumidifier side, by the heat pump, results in only a small change in the temperature of the air. This means that the air treated by the dehumidifier need neither be cooled by the air conditioner (as in the case of the desiccant systems of the prior art) nor need it be heated as is necessary if air conditioning systems are used to remove the moisture. This allows the air conditioning system to do the job it does best, namely removing heat from the air, while freeing them from any side effects of having a dehumidifier coupled to them, for example, the heating of the air into the air conditioner by the dehumidifier.

Figure 7:
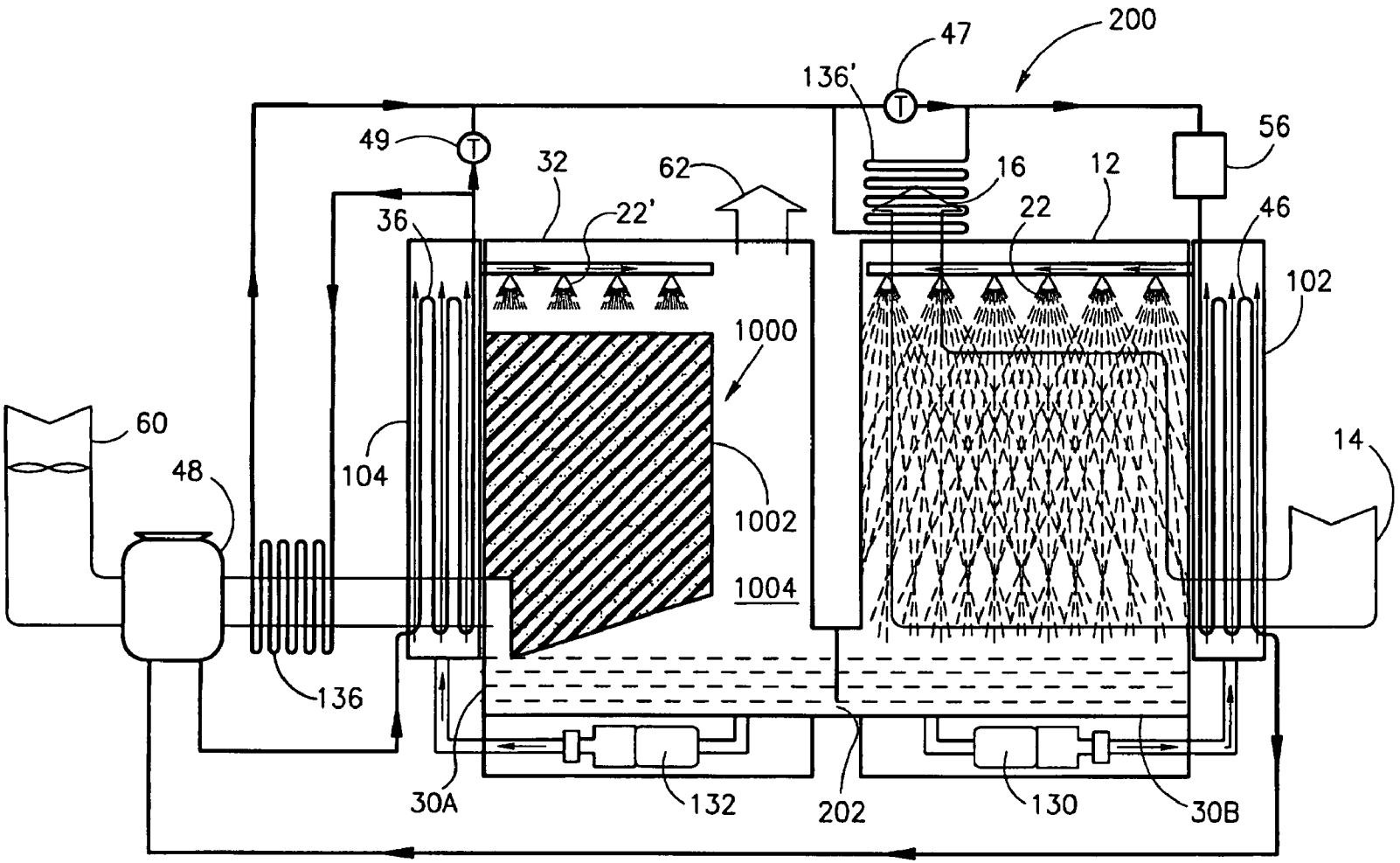
FIG. 7 shows a structure useful for automatically adjusting the amount of dehumidification.

FIG. 7 shows a structure 1000 useful for the control of the amount of dehumidification. In low ambient humidity situations, the level of liquid in the system is reduced, at steady state, over that in high humidity situations. In low humidity situations it is also desirable to reduce the amount of moisture removed from the ambient air. The structure of FIG. 7 is useful in providing automatic control to achieve these ends.

FIG, 7 is similar to FIG. 4C, except that a sponge-like material (as in FIG. 2), replaces the spray shown in FIG. 4C, for the regenerator. However, not all of volume of chamber 32 is filled with desiccant. A partition 1002 is provided to direct the incoming air to the desiccant when the liquid desiccant level is high. As the desiccant level falls below the bottom edge of the partition, air bypasses the sponge and passes through passage 1004, due to the much lower impedance of passage 1004. Thus, the dehumidifying action is reduced when it is not required.

Similarly, in regeneration chamber 32, the amount of water removed from the system is increased when the liquid level is high (high ambient humidity) and reduced when it is not.

Figure 8:
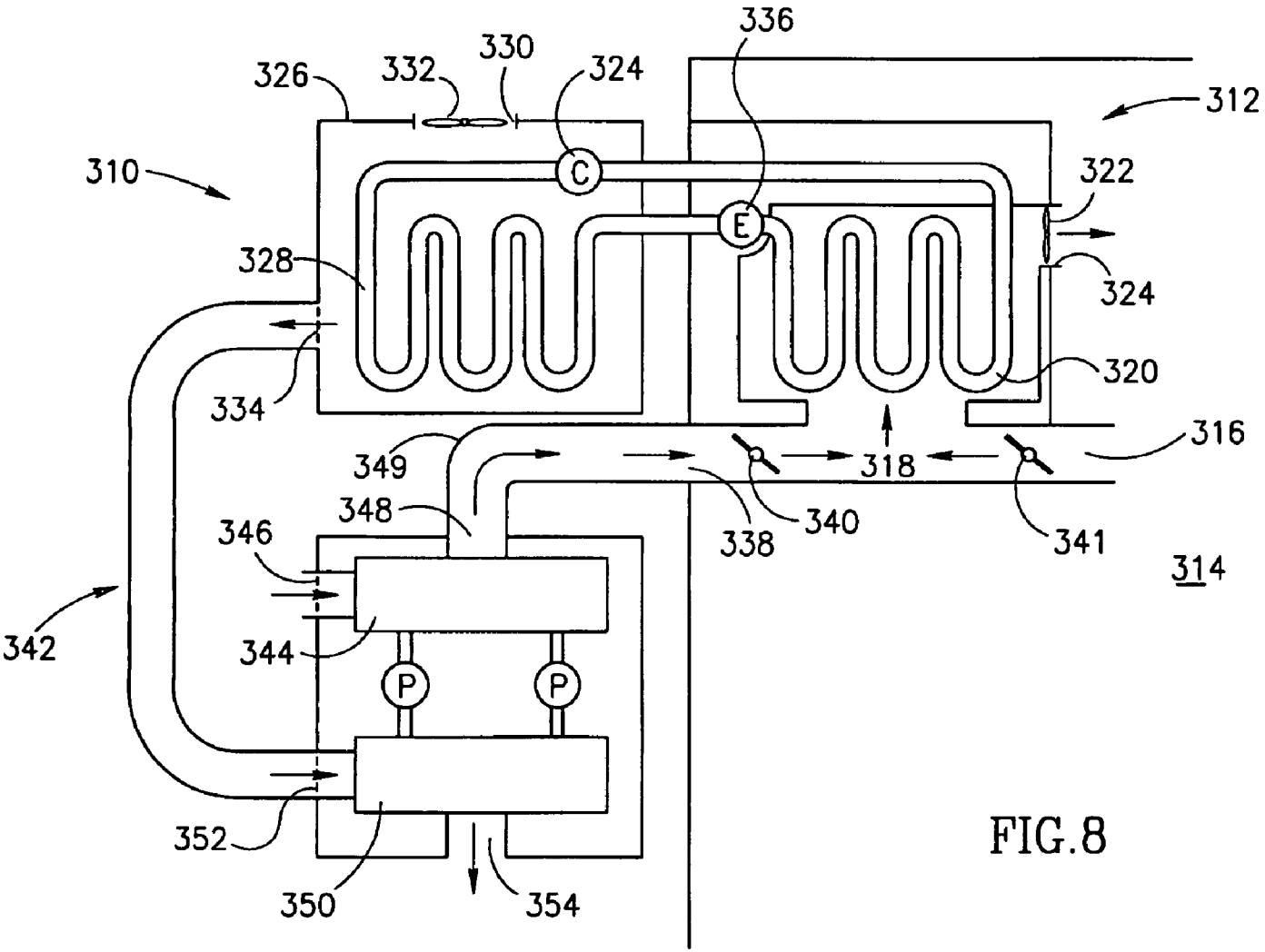
FIG. 8 is a schematic diagram of a combined dehumidifier/air-conditioner system in accordance with an embodiment of the invention.

FIG. 8 is a block diagram of a combined dehumidifier/air-conditioner system 310 in the context of a split air conditioner 312, such as is normally used to cool an enclosed area such as a large room 314 in a house. Air conditioner 312, in its simplest form, comprises a room air inlet 316 which feeds room air via a conduit 318 to an evaporator 320 which cools the air. Air from the room is drawn into evaporator 320 by a fan 322 and exists the evaporator via a room air outlet 324 to room 314.

Heated refrigerant is compressed by a compressor 324 (shown in an outside portion of air conditioner 312) and passed to a condenser 328. Condenser 328 is cooled by outside air drawn into a cooling inlet 330 by a fan 332. Heated air exits outside portion 326 via a waste heat outlet 334.

The cooled compressed refrigerant is expanded in an expander 336 and returns to evaporator 320 to be used to cool the room air.

Additionally, air conditioner 312 comprises a fresh air inlet 338 through which fresh air is brought in to the room. The quantity of fresh air is generally controlled by a louver or baffle system 340, 341. Either one or both louvers or baffles 340, 341 may be supplied, depending on the amount and type of control over the proportion of fresh air required. The fresh air is mixed with the air drawn from the room and is fed to evaporator 320.

Air conditioner 312, as described, is completely conventional in design. In some embodiments of the invention, other types of air conditioning systems may be used as appropriate.

In some embodiments of the invention, a dehumidifier unit 342 is utilized to increase the efficiency and cooling capacity of the air-conditioner.

Dehumidifier 342, in a simplified block diagram comprises a drying unit 344 which receives outside air via a wet air inlet 346 and passes dried air out of a dried air outlet 348. The air is dried in unit 344 by passing it through a mist, or the like, of liquid desiccant or desiccant solution. Moisture in the air is adsorbed by the desiccant. In an exemplary embodiment of the invention, dried air outlet 348 communicates with fresh air inlet 338 of air conditioner 312, for example, via a conduit 349. Since the impedance of drying unit is relatively low, no air pump, additional to fan 322 of the air conditioner is generally required. However, one may be provided, in some embodiments of the invention.

Desiccant with adsorbed water is transferred to a regenerator 350 in which the desiccant is regenerated by removing moisture from it, by heating the desiccant. In an exemplary embodiment of the invention, this heating (and the carrying away of the water vapor removed from the desiccant) is accomplished by passing hot air through the desiccant (optionally, the desiccant is in a mist or other finely divided form). The hot relatively dry air enters the dehumidifier via an inlet 352 and exits via an outlet 354. This hot air is conveniently and efficiently provided, in accordance with an embodiment of the invention, by connecting waste heat outlet 334 of air conditioner 312 with inlet 352 of the dehumidifier. Since the pressure drop in regenerator 350 is very low, optionally, no fan or other air pump in addition to fan 332 of air conditioner 312 is needed to move the air through the regenerator.

While, in some embodiment of the invention, no additional fans are required for moving air into or out of the dehumidifier, such fan or fans could be present, if convenient, as for example if stand alone dehumidifier and air conditioners are to be integrated as described herein.

Optionally, the air conditioner and dehumidifier share a common control panel from which both are controlled and from which, optionally, all the above functions can be turned on or off or adjusted.

In some embodiments of the invention, one of the systems of FIGS. 1–4 is used as dehumidifier 342. In these embodiments of the invention, port 348 of FIG. 4 corresponds to port 16 of FIGS. 1–4, port 352 corresponds to port 60, port 346 corresponds to port 14 and port 354 corresponds to port 62. It should be further understood that dehumidifier 342 is shown in very schematic form in FIG. 7 and that, for example, the placement of the elements may be different and many elements are not shown in FIG. 4. In addition, for the embodiments of FIG. 4 the pumps shown in FIG. 7 are not present. Furthermore, the heat-pumps of FIGS. 1–4 are not shown in FIG. 4, although they are preferably present in the system.

System 310 has a number of advantages over the prior art. As can be easily noted from FIG. 4, dehumidifier 342 can be an add on to air conditioner 312, which may be a standard unit. The task of drying incoming air, performed in a most inefficient manner by the air conditioner, has been transferred to a more efficient dehumidifier which utilizes waste heat from the air conditioner for most of its energy (only energy to pump the desiccant between dryer 344 and regenerator 350 is needed). The capacity of the air conditioner system for cooling is enhanced since it no longer needs to dry the air. The efficiency of the combined unit actually increases with increasing temperature in contrast to normal air conditioner systems. While the heat available is the heat developed by the air conditioner in cooling all of the air, the dehumidifier dries only part of the air, namely that entering the room. This balance means that the heating requirements for the dehumidifier are generally easily met by the air conditioner exhaust.

In addition, while air conditioning systems are generally not suitable for use in high humidity, low temperature situations, the system of the present invention is effective in these situations as well.

A combination device such as that described above, has shown a 60% cooling capacity over the air conditioner by itself and a 30% efficiency improvement over the use of an air conditioner by itself, for the same indoor air quality.

The invention has been described in the context of particular non-limiting embodiments. However, other combinations of air conditioning and dehumidifiers in accordance with the invention, as defined by the claims will occur to persons of skill in the art. For example, in FIG. 2, the heat is removed from liquid desiccant in the sump. Alternatively, it could be removed from liquid desiccant being transported to the drying chamber. In FIGS. 3 and 4 the heat is pumped from liquid desiccant while it is being transported to the drying chamber. Alternatively, it could be removed from the liquid desiccant in a sump that receives carrier liquid from the drying chamber. In some embodiments of the invention, one or both of the refrigerant/desiccant heat exchangers is in the dehumidifying or regenerating chambers.

FIG. 2 shows a different type of regenerator than does FIGS. 3 and 4. In some embodiments of the invention, the regenerator types are interchangeable. FIG. 2 shows the heat being transferred by the heat pump to the liquid in the regeneration chamber. Alternatively, or additionally, it can be transferred to liquid desiccant being transported to the regeneration chamber (as in FIGS. 3 and 4). Finally, while not shown in the FIGS., the heat could be transferred to liquid in sump 30A for all both FIGS. 3 and 4.

Additionally, while many features are shown in the exemplary embodiments, some of these features, although desirable, are not essential. For example, while the positions of heat exchangers 136 and 136' are shown as being at the entrance to the regenerator and at the exit from the dehumidifier, the air/refrigerant radiator may be in other places in the system, in some embodiments of the invention, although some of the features related with the positions shown may be lost.

As used in the claims the terms "comprise", "include" or "have" or their conjugates mean "including but not limited to".

What is claimed is:

1. Apparatus for conditioning air, comprising:

a quantity of liquid desiccant;

a first air-desiccant contact volume in which air to be conditioned is brought into contact with a first portion of the liquid desiccant;

a second air-desiccant contact volume in which outside air is brought into contact with a second portion of the liquid desiccant; and a refrigeration system comprising:

a first heat exchanger associated with the first portion of liquid desiccant;

a second heat exchanger associated with the second portion of liquid desiccant;

a third heat exchanger situated for heat exchange with said conditioned air after it leaves the first air-desiccant contact volume; and refrigerant conduits connecting elements of said refrigeration system.

2. Apparatus according to claim 1 wherein the first air-desiccant contact volume is comprised in a dehumidifier section in which air to be conditioned is brought into contact with a first portion of the liquid desiccant.

3. Apparatus according to claim 1 wherein the second air-desiccant contact volume is comprised in a regenerator section in which outside air is brought into contact with a second portion of the liquid desiccant.

4. Apparatus according to claim 1 wherein the third heat exchanger does not contact the liquid desiccant, and wherein conditioned air is heated by the third heat exchanger.

5. Apparatus according to claim 1, wherein the first heat exchanger is at a lower temperature than the second heat exchanger.

6. Apparatus according to claim 1 wherein the refrigeration system is operative to transfer heat from the first heat exchanger to the second heat exchanger.

7. Apparatus according to claim 1, wherein the refrigeration system comprises a compressor and conduits between said heat exchangers configured such that heat is transferred from the first heat exchanger to the second heat exchanger.

8. Apparatus according to claim 1, including a conduit for water molecules, wherein the apparatus is configured such that the air to be conditioned is dehumidified in the first contact volume and wherein water removed in the dehumidification is transferred to the outside air from the second contact volume, said water being transferred to the first contact volume via the conduit.

9. Apparatus according to claim 8 wherein there is no pumping of liquid desiccant between a dehumidifier comprising the first contact volume and a regenerator comprising the second contact volume.

10. Apparatus according to claim 8 and including a pump for pumping of liquid desiccant between a dehumidifier comprising the first contact volume and a regenerator comprising the second contact volume.

11. Apparatus according to claim 1 and also including a fourth heat exchanger.

12. Apparatus according to claim 11 wherein the fourth heat exchange apparatus is situated for heat exchange with said outside air before it enters the regenerator, such that the outside air is heated thereby.

13. Apparatus according to claim 11, wherein said refrigerant conduits have a controllable configuration enabling a plurality of flow configurations, each said configuration providing a different path of refrigerant between the elements of the refrigerant system.

14. Apparatus according to claim 13 wherein said configuration is selectable by valves.

15. Apparatus according to claim 13 wherein the plurality of configurations includes a first configuration in which heat is transferred from the first heat exchanger to the second and third heat exchangers, thereby to heat the conditioned air.

16. Apparatus according to claim 15 wherein the refrigerant in the second heat exchanger is at a higher temperature than the refrigerant in the first heat exchanger.

17. Apparatus according to claim 15 wherein the refrigerant in the third heat exchanger is at a higher temperature than the refrigerant in the first heat exchanger.

18. Apparatus according to claim 15 wherein for the first configuration no refrigerant flows in the fourth heat exchanger.

19. Apparatus according to claim 13 wherein the plurality of configurations includes a second configuration in which heat is transferred from the first heat exchanger to the second and fourth heat exchangers.

20. Apparatus according to claim 19 wherein the refrigerant in the second heat exchanger is at a higher temperature than the refrigerant in the first heat exchanger.

21. Apparatus according to claim 19 wherein the refrigerant in the fourth heat exchanger is at a higher temperature than the refrigerant in the first heat exchanger.

22. Apparatus according to claim 19, wherein for the second configuration, no refrigerant flows in the third heat exchanger.

23. Apparatus according to claim 13 wherein the plurality of configurations includes a third configuration in which heat is transferred from the second heat exchanger to the third heat exchanger.

24. Apparatus according to claim 23 wherein for the third configuration, the temperature of refrigerant in the third heat exchanger is higher than the temperature of refrigerant in the second heat exchanger.

25. Apparatus according to claim 23 wherein for the third configuration, heat is transferred from the second heat exchanger to the fourth heat exchanger.

26. Apparatus according to claim 25 wherein for the third configuration the temperature of refrigerant in the fourth heat exchanger is higher than the temperature of refrigerant in the second heat exchanger.

27. Apparatus according to claim 23 wherein for the third configuration no refrigerant flows in the first heat exchanger.

28. Apparatus for conditioning air, wherein said conditioned air is heated and dehumidified, comprising:

a quantity of liquid desiccant;

a first air-desiccant contact volume in which air to be conditioned is brought into contact with a first portion of the liquid desiccant;

a second air-desiccant contact volume in which outside air is brought into contact with a second portion of the liquid desiccant; and a refrigeration system comprising:

a first heat exchanger associated with the first portion of liquid desiccant;

a second heat exchanger associated with the second portion of liquid desiccant;

a third heat exchanger situated for heat exchange with said conditioned air after it leaves the first air-desiccant contact volume; and refrigerant conduits connecting elements of said refrigeration system;

wherein said conditioned air is heated by said third heat exchanger and is dehumidified by said first air-desiccant volume.

* * * * *